US008119562B2

(12) United States Patent
Teramae

(10) Patent No.: US 8,119,562 B2
(45) Date of Patent: Feb. 21, 2012

(54) HEAT-SENSITIVE TRANSFER SHEET AND IMAGE-FORMING METHOD USING HEAT-SENSITIVE TRANSFER SYSTEM

(75) Inventor: Shinichi Teramae, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 999 days.

(21) Appl. No.: 12/058,568

(22) Filed: Mar. 28, 2008

(65) Prior Publication Data

US 2008/0287291 A1 Nov. 20, 2008

(30) Foreign Application Priority Data

Mar. 29, 2007 (JP) ..... 2007-088572

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS 4,780,355 A 10/1988 Sugiyama et al.

FOREIGN PATENT DOCUMENTS

| | | |
|---|---|---|
| EP | 0 383 267 A2 | 8/1990 |
| JP | 9-202058 | 8/1997 |
| JP | 2003-159880 | 6/2003 |

*Primary Examiner* — Bruce H Hess
(74) *Attorney, Agent, or Firm* — Sughrue Mion, PLLC

(57) ABSTRACT

A heat-sensitive transfer sheet that is used in an image-forming method using a heat-sensitive transfer system, which method comprises the steps of superposing the heat-sensitive transfer sheet having at least one yellow heat transfer layer, at least one magenta heat transfer layer, and at least one cyan heat transfer layer on a support, and a heat-sensitive transfer image-receiving sheet having at least one dye receptor layer on a support, and then transferring at least three kinds of heat transferable dyes to the dye receptor layer sequentially, which heat-sensitive transfer sheet satisfies the following Formula (1):

$$\mu 1 > \mu 2 > \mu 3m \qquad \text{Formula (1)}$$

where μ1, μ2 and μ3 are coefficients of static friction as defined herein.

4 Claims, 2 Drawing Sheets

HEAT-SENSITIVE TRANSFER SHEET AND IMAGE-FORMING METHOD USING HEAT-SENSITIVE TRANSFER SYSTEM

FIELD OF THE INVENTION

The present invention relates to a heat-sensitive transfer sheet and a method of forming an image using a heat-sensitive transfer system that is free from printing failure owing to sticking.

BACKGROUND OF THE INVENTION

Various heat transfer recording methods have been known so far. Among these methods, dye diffusion transfer recording systems attract attention as a process that can produce a color hard copy having an image quality closest to that of silver halide photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver halide photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, or four colors which consists of the three colors and black, are used for recording a color image by overlapping one color to other, thereby enabling transferring and recording a color image having continuous gradation for color densities.

In such the recording system, the heat-sensitive transfer sheet and the heat-sensitive transfer image-receiving sheet are heated at the state of superposition. Consequently, releasing properties between them after transfer are important. In the case where the releasing properties are insufficient, there was a problem that the sticking occurred, resulting in unevenness of print density.

There are proposed a method of depositing a silicone graft polymer and a polysiloxane compound on the heat-sensitive transfer sheet (JP-A-9-202058 ("JP-A" means unexamined published Japanese patent application)) and a method of depositing a releasing agent comprising a copolymer of silicone and a polyamidoimide resin on the heat-sensitive transfer sheet (JP-A-2003-159880). However, from recent demands for speeding-up of printing, further improvement has been desired.

SUMMARY OF THE INVENTION

The present invention resides in a heat-sensitive transfer sheet that is used in an image-forming method using a heat-sensitive transfer system, which method comprises the steps of superposing the heat-sensitive transfer sheet having at least one yellow heat transfer layer, at least one magenta heat transfer layer, and at least one cyan heat transfer layer on a support, and a heat-sensitive transfer image-receiving sheet having at least one dye receptor layer on a support, and then transferring at least three kinds of heat transferable dyes to the dye receptor layer sequentially, which heat-sensitive transfer sheet satisfies the following Formula (1):

$$\mu1>\mu2>\mu3, \qquad \text{Formula (1)}$$

where μ1 is a coefficient of static friction between a first color heat transfer layer and the image-receiving sheet having a value in a range from 0.4 to 1.0, and μ2 is a coefficient of static friction between a second color heat transfer layer and a first color solid print image-receiving sheet having a value in a range from 0.2 to 0.8, and μ3 is a coefficient of static friction between a third color heat transfer layer and a first color/second color solid print image-receiving sheet having a value in a range from 0.1 to 0.6.

Further, the present invention resides in an image-forming method using a heat-sensitive transfer system comprising the steps of:

superposing a heat-sensitive transfer sheet having at least one yellow heat transfer layer, at least one magenta heat transfer layer, and at least one cyan heat transfer layer on a support and a heat-sensitive transfer image-receiving sheet having at least one dye receptor layer on a support, and then transferring at least three kinds of heat transferable dyes to the dye receptor layer sequentially, said image-forming method satisfying the following Formula (1):

$$\mu1>\mu2>\mu3, \qquad \text{Formula (1)}$$

where μ1 is a coefficient of static friction between a first color heat transfer layer and the image-receiving sheet having a value in a range from 0.4 to 1.0, and μ2 is a coefficient of static friction between a second color heat transfer layer and a first color solid print image-receiving sheet having a value in a range from 0.2 to 0.8, and μ3 is a coefficient of static friction between a third color heat transfer layer and a first color/second color solid print image-receiving sheet having a value in a range from 0.1 to 0.6.

Other and further features and advantages of the invention will appear more fully from the following description, appropriately referring to the accompanying drawings.

DETAILED DESCRIPTION OF THE INVENTION

Figure 1:
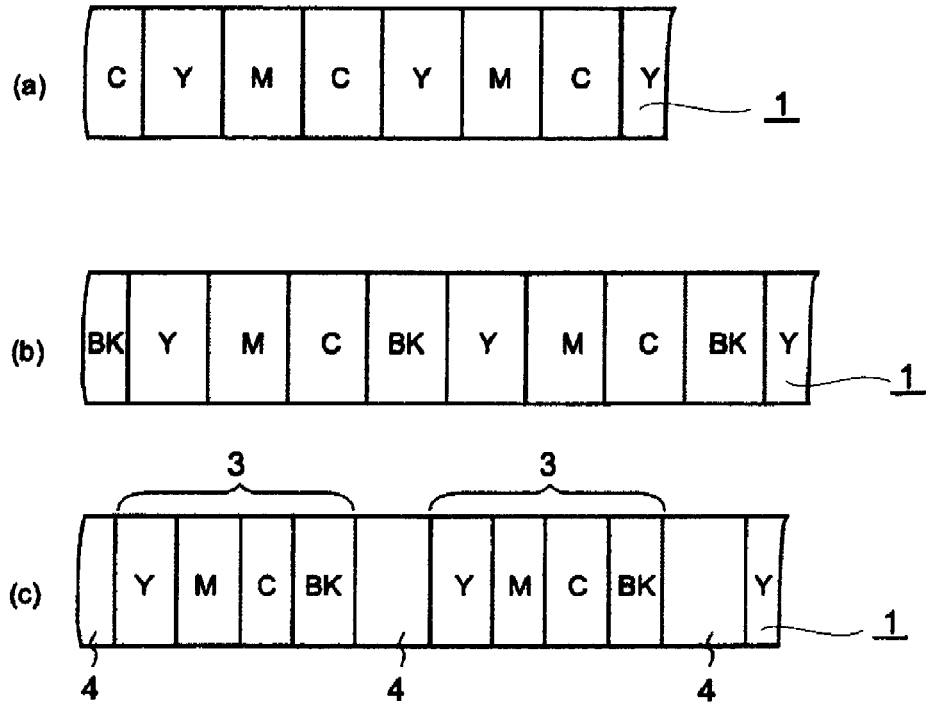
FIG. 1 shows an example of a heat-sensitive transfer layer of the present invention.

The present invention provides the following means:

(1) A heat-sensitive transfer sheet that is used in an image-forming method using a heat-sensitive transfer system, which method comprises the steps of superposing the heat-sensitive transfer sheet having at least one yellow heat transfer layer, at least one magenta heat transfer layer, and at least one cyan heat transfer layer on a support, and a heat-sensitive transfer image-receiving sheet having at least one dye receptor layer on a support, and then transferring at least three kinds of heat transferable dyes to the dye receptor layer sequentially, which heat-sensitive transfer sheet satisfies the following Formula (1):

$$\mu1>\mu2>\mu3, \qquad \text{Formula (1)}$$

where μ1 is a coefficient of static friction between a first color heat transfer layer and the image-receiving sheet having a value in a range from 0.4 to 1.0, and μ2 is a coefficient of static friction between a second color heat transfer layer and a first color solid print image-receiving sheet having a value in a range from 0.2 to 0.8, and μ3 is a coefficient of static friction between a third color heat transfer layer and a first color/second color solid print image-receiving sheet having a value in a range from 0.1 to 0.6.

(2) The heat-sensitive transfer sheet as described in (1), wherein said heat-sensitive transfer image-receiving sheet contains hollow polymer particles and a hydrophilic polymer between the dye receptor layer and the support.

(3) The heat-sensitive transfer sheet as described in (1) or (2), wherein said first color heat transfer layer is the yellow heat transfer layer, said second color heat transfer layer is the magenta heat transfer layer, and said third color heat transfer layer is the cyan heat transfer.

(4) An image-forming method using a heat-sensitive transfer system comprising the steps of:

superposing a heat-sensitive transfer sheet having at least one yellow heat transfer layer, at least one magenta heat transfer layer, and at least one cyan heat transfer layer on a support and a heat-sensitive transfer image-receiving sheet having at least one dye receptor layer on a support, and then transferring at least three kinds of heat transferable dyes to the dye receptor layer sequentially, said image-forming method satisfying the following Formula (1):

$$\mu1>\mu2>\mu3, \qquad \text{Formula (1)}$$

where μ1 is a coefficient of static friction between a first color heat transfer layer and the image-receiving sheet having a value in a range from 0.4 to 1.0, and μ2 is a coefficient of static friction between a second color heat transfer layer and a first color solid print image-receiving sheet having a value in a range from 0.2 to 0.8, and μ3 is a coefficient of static friction between a third color heat transfer layer and a first color/second color solid print image-receiving sheet having a value in a range from 0.1 to 0.6.

(5) The image-forming method as described in (4), wherein said first color heat transfer layer is the yellow heat transfer layer, said second color heat transfer layer is the magenta heat transfer layer, and said third color heat transfer layer is the cyan heat transfer.

The present invention will be explained in detail below.

1) Heat-Sensitive Transfer Sheet

The following is an explanation of the heat-sensitive transfer sheet (ink sheet) that is used in the present invention.

The ink sheet that is used in combination with the above-described heat-sensitive transfer image-receiving sheet at the time of heat-sensitive transfer image formation comprises a support and a heat transfer layer containing a diffusion transfer dye (hereinafter, sometimes referred to as a dye layer) disposed on the support. Any kinds of ink sheets can be used in the present invention. It is preferred that each of coloring material layers of three primary colors, namely yellow, magenta and cyan, is formed in order to the longitudinal direction of the ink sheet (i.e., they are formed in order corresponding to the record face area of the heat-sensitive transfer image-receiving sheet). It is further preferred that a protective layer transfer part is formed next to the cyan coloring material layer.

In the heat-sensitive transfer sheet of the present invention, coefficient of static friction reduces in order of coefficient of static friction (μ1) between the first color heat transfer layer and the image-receiving sheet (which is an un-transferred, image-receiving sheet), coefficient of static friction (μ2) between the second color heat transfer layer and the first color solid print image-receiving sheet, and coefficient of static friction (μ3) between the third color heat transfer layer and the first color and second color solid print image-receiving sheet.

Herein, the term "solid print" means a print formed by transferring the maximum density of a dye in the ink sheet to throughout an area in the image-receiving sheet.

In the present specification, the term "the first color solid print image-receiving sheet" means an image-receiving sheet having a solid-print, transferred-dye image which is formed by transferring the dye in the first color heat transfer layer of the ink sheet to an un-transferred, image-receiving sheet. The term "the first color/second color solid print image-receiving sheet" means an image-receiving sheet having a solid-print, transferred-dye image which is formed by transferring the dye in the second heat transfer layer of the ink sheet onto the first color image on the first color solid print image-receiving sheet.

In other words, in the present invention, the first solid print image-receiving sheet means an image-receiving sheet having a transferred-dye image of the first color as a solid print. The first color/second color solid print image-receiving sheet means an image-receiving sheet having a transferred-dye image of the first color and second color as a solid print. In the present invention, a transferred-dye image (solid image) of the first color in the receiving sheet can be formed by transferring the maximum density of the first color in the ink sheet to throughout an area in an un-transferred, image-receiving sheet. Then, a transferred-dye image of the first color and second color in the receiving sheet can be formed by transferring the maximum density of the second color in the ink sheet to throughout the area in which the transferred-dye image of the first color has been formed, so as to be superposed thereon. In the present invention, a full color image can be formed by transferring at least three images, i.e., yellow, magenta and cyan images, to one image-receiving sheet, from the first, second, and third color heat transfer layers provided on the ink sheet.

μ1 ranges from 0.4 to 1.0, preferably from 0.5 to 0.9. μ2 ranges from 0.2 to 0.8, preferably from 0.3 to 0.7. μ3 ranges from 0.1 to 0.6, preferably from 0.2 to 0.5. A difference between μ1 and μ2 ranges from 0.1 to 0.8, preferably from 0.1 to 0.7. A difference between μ2 and μ3 ranges from 0.1 to 0.7, preferably from 0.1 to 0.6. A difference between μ1 and μ3 ranges from 0.1 to 0.9, preferably from 0.1 to 0.7. Further, the first color heat transfer layer is preferably a yellow heat transfer layer, the second color heat transfer layer is preferably a magenta heat transfer layer, and the third color heat transfer layer is preferably a cyan heat transfer.

In order to provide the coefficient of static friction according to the present invention, it is preferred to contain a releasing agent in a heat transfer layer. As the releasing agent, solid waxes such as polyethylene wax, amide wax and Teflon (registered trade name) powder; silicone oil, phosphate-series compounds, polymers having at a side chain a fluoro aliphatic group (namely an aliphatic group whose hydrogen atom is substituted with at least one fluorine atom), silicone-based surfactants and others including releasing agents known in the technical fields concerned may be used. Among these, especially preferred are polymers having a fluoro aliphatic group at a side chain, silicone-based surfactants and silicone-series compounds such as silicone oil and/or its hardened products.

The polymers having a fluoro aliphatic group at a side chain can be derived from a fluoro aliphatic compound produced by a telomerization method that is also called a telomer method, or an oligomerization method that is also called an oligomer method. The fluoro aliphatic compound can be synthesized by a method described in the publication of JP-A-2002-90991.

As the polymers having a fluoro aliphatic group at a side chain, preferred are copolymers of a monomer having a fluoro aliphatic group and poly(oxyalkylene)acrylate and/or poly(oxyalkylene)methacrylate.

They may be distributed irregularly, or block polymerized. Examples of the poly(oxyalkylene) group include poly(oxyethylene) group, poly(oxypropylene) group, and poly(oxybutylene) group. Further, the poly(oxyalkylene) group may be an unit having alkylene groups of chain lengths different from each other in the same chain length, such as poly(block connector of oxyethylene and oxypropylene and oxyethylene) and poly(block connector of oxyethylene and oxypropylene). Further, the copolymer of a monomer having a fluoro aliphatic group and poly(oxyalkylene)acrylate or methacrylate is not limited to binary copolymers, but may be ternary or more multiple copolymers that can be produced by copolymerizing, at the same time, several different co-monomers such as monomers having two or more different fluoro aliphatic groups and two or more different kinds of poly(oxyalkylene)acrylate or methacrylate.

An average molecular weight of the polymers having a fluoro aliphatic group at a side chain ranges from 5,000 to 50,000, preferably from 8,000 to 30,000, and more preferably from 10,000 to 20,000.

Examples of the copolymers include copolymers of acrylate (or methacrylate) having a $C_4F_9$ group and poly(oxyalkylene)acrylate (or methacrylate), copolymers of acrylate (or methacrylate) having a $C_4F_9$ group, poly(oxyethylene)acrylate (or methacrylate) and poly(oxypropylene)acrylate (or methacrylate), copolymers of acrylate (or methacrylate) having a $C_6F_{13}$ group and poly(oxyalkylene)acrylate (or methacrylate), copolymers of acrylate (or methacrylate) having a $C_6F_{13}$ group, poly(oxyethylene)acrylate (or methacrylate) and poly(oxypropylene)acrylate (or methacrylate), copolymers of acrylate (or methacrylate) having a $C_8F_{17}$ group and poly(oxyalkylene)acrylate (or methacrylate), and copolymers of acrylate (or methacrylate) having a $C_8F_{17}$ group, poly(oxyethylene)acrylate (or methacrylate) and poly(oxypropylene)acrylate (or methacrylate).

Further, the polymers having a fluoro aliphatic group at a side chain are commercially available referring to a general name such as "perfluoroalkyl-containing oligomers". For example, the following products can be used. As the products of Dainippon Ink & Chemicals Incorporated, there are Megafac F-470, Megafac F-471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K, Megafac F-178RM (each product name). As the products of Sumitomo 3 M Limited, there are Novec™ FC-4430 and FC-4432 (each product name).

As the silicone oil, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are, manufactured by Shin-Etsu Chemical Co., Ltd.). Examples of the methylphenylsilicone oil include KF50-100, KF54 and KF56 (all of these names are, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are, manufactured by Shin-Etsu Chemical Co., Ltd.). Examples of the epoxy-modified silicone oil include KF-100T, KF-101, KF-60-164, KF-103, X-22-343 and X-22-3000T (all of these names are, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are, manufactured by Shin-Etsu Chemical Co., Ltd.). Examples of the methacryl-modified silicone oil include X-22-164A, X-22-164C, X-24-8201, X-22-174D and X-22-2426 (all of these names are, manufactured by Shin-Etsu Chemical Co., Ltd.).

Reactive silicone oils may be hardened upon use, and are classified into a reaction-curable type, photocurable type, catalyst-curable type, and the like. Among these types, the reaction-curable type silicone oil is particularly preferable. As the reaction-curable type silicone oil, products obtained by reacting an amino-modified silicone oil with an epoxy-modified silicone oil and then by curing are preferable. Also, examples of the catalyst-curable type or photocurable type silicone oil include KS-705F-PS, KS-705F-PS-1 and KS-770-PL-3 (all of these names are, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.).

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 (trade name, manufactured by Shin-Etsu Chemical Co., Ltd.). Modified silicones represented by any one of the following Formulae 1 to 3 may also be used.

Formula 1

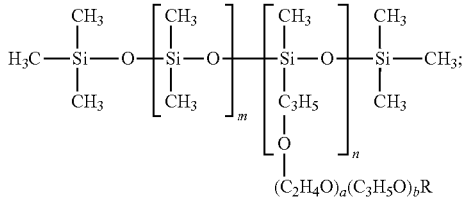

Formula 2

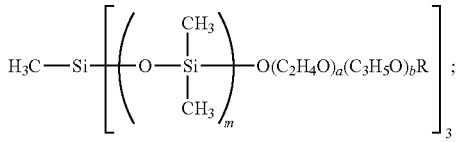

-continued

Formula 3

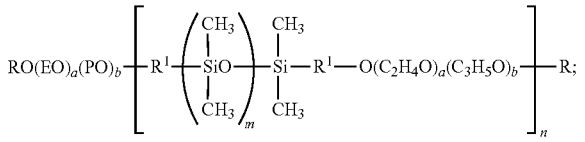

In the Formula 1, R represents a hydrogen atom, a straight-chain or branched alkyl group which may be substituted with an aryl or cycloalkyl group. m and n respectively denote an integer of 2,000 or less, and a and b respectively denote an integer of 30 or less.

In the Formula 2, R represents a hydrogen atom, a straight-chain or branched alkyl group which may be substituted with an aryl or cycloalkyl group. m denotes an integer of 2,000 or less, and a and b respectively denote an integer of 30 or less.

In the Formula 3, R represents a hydrogen atom, a straight-chain or branched alkyl group which may be substituted with an aryl or cycloalkyl group. m and n respectively denote an integer of 2,000 or less, and a and b respectively denote an integer of 30 or less. $R^1$ represents a single bond or a divalent linking group, E represents an ethylene group which may be further substituted, and P represents a propylene group which may be further substituted.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

It is known that an addition polymerization-type silicone generally promotes a hardening reaction in the presence of a catalyst, and that almost all of complexes of transition metal of VIII group, such as Fe group and Pt group, are effective as the hardening catalyst. Among these, a platinum compound has the highest efficiency in general, and a platinum catalyst, which is generally a platinum complex soluble in the silicone oil, is preferably used. Addition amount necessary for the reaction is generally sufficiently about 1 to 100 ppm.

This platinum catalyst has a strong interaction with an organic compound containing an element such as N, P or S, an ionic compound of heavy metal such as Sn, Pb, Hg, Bi or As, or an organic compound containing a polyvalent bond such as an acetylene group. Therefore, if the above-described compounds (catalyst poison) are used together with the platinum catalyst, the ability of the catalyst to hydrosilylate is lost. Resultantly, the platinum catalyst cannot work as the hardening catalyst. Therefore, a problem arises that the platinum catalyst causes silicone to lack in hardening ability, when used with such a catalyst poison (See "Silicone Handbook" published by Nikkan Kogyo Shunbun shya). As a result, such an addition polymerization-type silicone causing such a hardening failure cannot show a releasability needed, when it is used in the receptor layer. As a hardener reacting with an active hydrogen, it is considered to use an isocyanate compound. However, this isocyanate compound and an organic tin compound working as a catalyst to the isocyanate compound act as a catalyst poison to the platinum catalyst. Therefore, the addition polymerization-type silicone has been never used together with the isocyanate compound in the past. Resultantly, the addition polymerization-type silicone has been never used together with a modified silicone having an active hydrogen that shows a releasability needed when hardened with the isocyanate compound.

However, the hardening failure of the addition polymerization-type silicone can be prevented by 1) setting an equivalent amount of the reactive group of the hardener capable of reacting with the active hydrogen, to the reactive group of both the thermoplastic resin and the modified silicone having an active hydrogen, in the range of from 1:1 to 10:1, and 2) setting an addition amount of the platinum catalyst based on the addition polymerization-type silicone in the range of 100 to 10,000 ppm in terms of platinum atom of the platinum catalyst. If the equivalent amount of the reactive group of the hardener capable of reacting with the active hydrogen according to the 1) described above is too small, an amount of silicone having an active hydrogen hardened with an active hydrogen of the thermoplastic resin is so small that an excellent releasability needed cannot be achieved. On the other hand, if the equivalent ratio is too large, a time which is allowed to use an ink in a coating solution for the receptor layer is so short that such the equivalent ratio cannot be substantially applied to the present invention. Beside, if the addition amount of the platinum catalyst according to the 2) described above is too small, activity is lost by the catalyst poison, whereas if the addition amount is too large, a time which is allowed to use an ink in a coating solution for the receptor layer is so short that such the addition amount cannot be substantially applied to the present invention.

A coating amount of the releasing agent preferably ranges from 0.1 to 20 $mg/m^2$, and more preferably from 1 to 10 $mg/m^2$. In order to lower the coefficient of static friction in order of μ1, μ2 and μ3, it is preferred to increase the coating amount of the releasing agent in order of the first color heat transfer layer, the second color heat transfer layer, and the third color heat transfer layer. A difference between coating amounts of the releasing agent of the first color heat transfer layer and the second color heat transfer layer is preferably 0.5 $mg/m^2$ or more, more preferably 1.0 $mg/m^2$ or more. A difference between coating amounts of the releasing agent of the second color heat transfer layer and the third color heat transfer layer is preferably 0.5 $mg/m^2$ or more, more preferably 1.0 $mg/m^2$ or more. A difference between coating amounts of the releasing agent of the first color heat transfer layer and the third color heat transfer layer is preferably 1.0 $mg/m^2$ or more, more preferably 2.0 $mg/m^2$ or more. Herein, with respect to the coating amount of the releasing agent of each color heat transfer layer, the coating amount of the releasing agent of the first color heat transfer layer is preferably 0.1 $mg/m^2$ to 15 $mg/m^2$, more preferably 0.1 $mg/m^2$ to 10 $mg/m^2$. The coating amount of the releasing agent of the second color heat transfer layer is preferably 0.65 $mg/m^2$ to 15 $mg/m^2$, more preferably 0.65 $mg/m^2$ to 10 $mg/m^2$. The coating amount of the releasing agent of the third color heat transfer layer is preferably 1.7 $mg/m^2$ to 20 $mg/m^2$, more preferably 2.0 $mg/m^2$ to 15 $mg/m^2$.

The kind of the support is not limited in particular. Examples of the support include plastics such as polyester, polypropylene, cellophane, polycarbonate, cellulose acetate, polyethylene, polyvinylchloride, polystyrene, nylon, polyimide, polyvinylidene chloride, and ionomer; and a composite substrate film of these plastics and the above-exemplified paper. The thickness of the support may be properly changed according to the materials used for the support so that physical properties thereof such as strength and heat resistance become suitable. A preferable thickness of the support is from 3 μm to 100 μm.

As a binder resin that is contained in a dye ink in order to carry a diffusion transfer dye, various kinds of materials are known and may be used in the present invention. Examples of the resin include modified cellulosic resins such as ethyl cellulose, hydroxyethyl cellulose, ethylhydroxy cellulose, hydroxypropyl cellulose, ethylhydroxyethy cellulose, methyl cellulose, cellulose acetate, cellulose acetate butyrate, cellulose acetate propionate, and cellulose nitrate; vinyl resins such as polyvinyl alcohol, polyvinyl acetate, polyvinyl butyral, polyvinyl acetal, polyvinyl pyrrolidone, polystyrene, and polyvinyl chloride; acrylic resins such as polyacrylonitrile, polyacrylic acid esters, and polyacrylamide; polyurethane resins; polyamide resins; polyester resins; polycarbonate resins; phenoxy resins; phenolic resins; epoxy resins; and various kinds of elastomers. Each of them can be suitably used in the present invention. These resins may be used singly. Besides, it is also possible to use them as a mixture, or alternatively as a copolymer of monomer components different from each other that constitute the above-described resins in the case where the resin is a polymer. It is also a preferable embodiment to cross-link the resins with a cross-linking agent. Further, in order to provide a specific value of coefficient of static friction according to the present invention, it is also preferable to use a silicone resin in which silicone is copolymerized in the binder resin.

The dye for use in the present invention is not particularly limited, so far as the dye is able to diffuse by heat, able to be incorporated in a sublimation type heat-sensitive transfer sheet, and able to transfer by heat from the sublimation type heat-sensitive transfer sheet to a heat-sensitive transfer image-receiving sheet. Accordingly, as the dye that is used for the heat-sensitive transfer sheet, ordinarily used dyes or known dyes can be effectively used.

Preferable examples of the dye include diarylmethane-series dyes; triarylmethane-series dyes; thiazole-series dyes; methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thazine-series dyes; azine-series dyes; acridine-series dyes; benzene azo-series dyes; azo-series dye such as pyridone azo, thiophene azo, isothiazole azo, pyrol azo, pyralazo, imidazole azo, thiadiazole azo, triazole azo, disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together. For instance, a black hue can be obtained from a combination of dyes.

Dyes that can be preferably used in the present invention are explained in detail below.

In the heat transfer layer of the ink sheet that is used in the present invention, use can be made of dyes that have been usually employed as a yellow dye. Among these, at least one dye represented by any one of formulae (Y1) to (Y4) is preferably contained in the heat transfer layer. However, the yellow dye that can be used in the present invention is not limited to these dyes.

First, the dye represented by formula (Y1) is explained in detail below.

Formula (Y1)

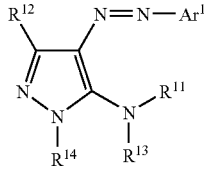

In formula (Y1), $Ar^1$, $R^{12}$ and $R^{14}$ represent a monovalent substituent. $R^{11}$ and $R^{13}$ represent a hydrogen atom or a monovalent substituent. There is no particular limitation on the substituent. Representative examples of the substituent include a halogen atom, an alkyl group, an alkenyl group, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group (including an alkylamino group, an anilino group, and a heterocyclic amino group), an acylamino group, an aminocarbonylamino group, an alkoxycarbonylamino group, an aryloxycarbonylamino group, a sulfamoylamino group, an alkyl- or aryl-sulfonylamino group, an alkylthio group, a sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group. Each of these groups may further be substituted.

In formula (Y1), $R^{13}$ and $R^{14}$ may be bonded together to form a ring. There is no particular limitation to the atoms necessary to form a ring. Typical examples are atoms represented by —C($R^{15}$)═N—, —N═C($R^{15}$)—, —C(═O)—C($R^{15}$)═C($R^{16}$)—, or —C(═O)—N($R^{15}$—C(═O)—, wherein $R^{15}$ and $R^{16}$ each independently represent a hydrogen atom or a substituent. Examples of the substituent are the same as examples of the substituent represented by $R^{11}$, $R^2$, $R^{13}$ and $R^{14}$.

$R^{12}$ is preferably a hydrogen atom, an alkyl group, an alkoxy group, an aryl group, an alkoxycarbonyl group, a cyano group, or a carbamoyl group, $R^{14}$ is preferably a hydrogen atom, an alkyl group, an aryl group, or a heteroaryl group. $R^{11}$ and $R^{13}$ each are preferably a hydrogen atom or an alkyl group. Further, each of the above-mentioned groups may further be substituted.

In formula (Y1), $Ar^1$ is preferably an aryl group that may be substituted with a substituent. Examples of the substituent include those groups exemplified above as a substituent of $R^{11}$, $R^{12}$, $R^{13}$ and $R^{14}$, and in addition, an alkyloxycarbonyl group, a sulfonyl group, a sulfonylamino group, a hydroxyl group, and a nitro group. Further, a heterocyclic group is also preferred as $Ar^1$. Preferable examples of the heterocyclic group include an imidazolyl group, a pyridyl group, a pyrazolyl group, a thiazolyl group, a benzoimidazolyl group, a quinonyl group, a benzopyrazolyl group, a benzothiazolyl group, an isothiazolyl group, a benzoisothiazolyl group, a pyridoisothiazolyl group, and a thiadiazolyl group.

The maximum absorption wavelength of the azo dye represented by formula (Y1) is preferably in the range of from 400 nm to 480 nm, more preferably from 420 nm to 460 nm.

Preferable examples of the compound represented by formula (Y1) are shown below, but the compounds that can be used in the present invention are not limited to the following specific examples.

Y1-1
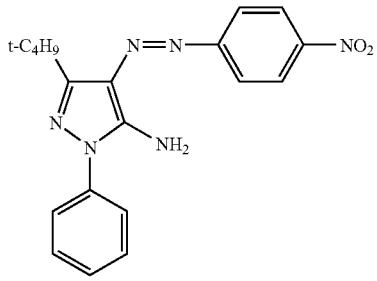
Y1-2
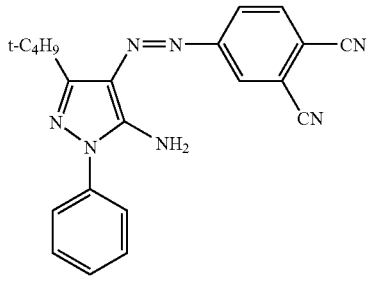
Y1-3
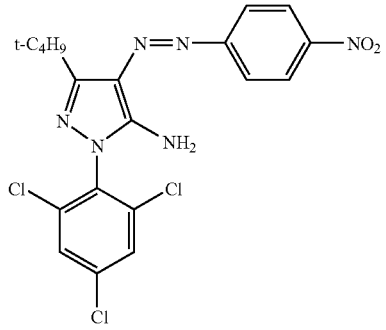
Y1-4
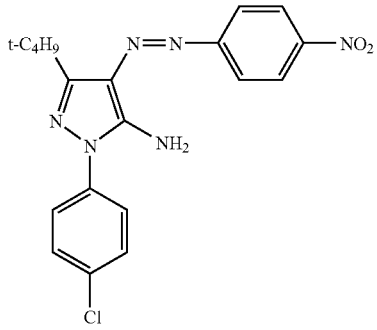
Y1-5
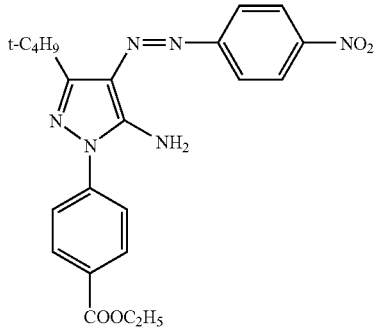
-continued
Y1-6
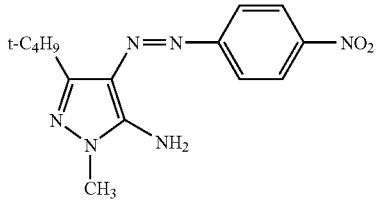
Y1-7
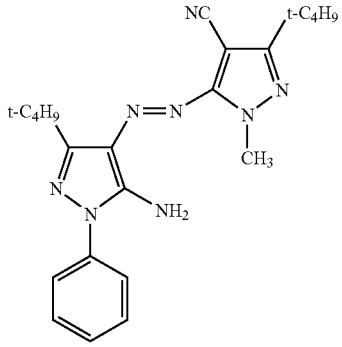
Y1-8
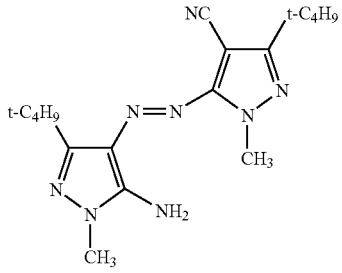
Y1-9
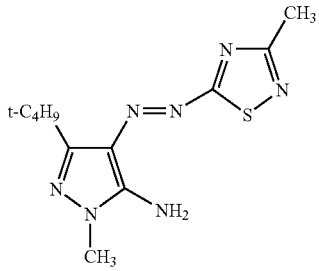
Y1-10
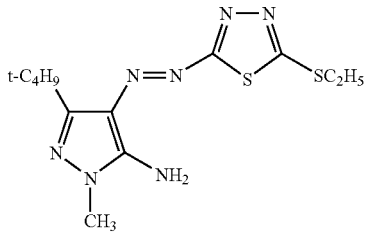
Next, the dye represented by formula (Y2) is explained in detail below.

Formula (Y2)

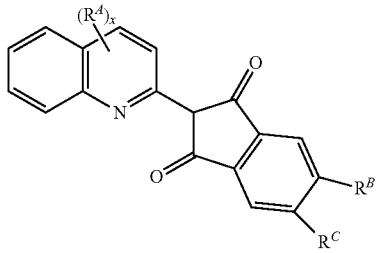

In formula (Y2), $R^A$ represents a substituent, and is preferably a halogen atom, a hydroxyl group, an alkyl group having 1 to 8 carbon atoms, a cycloalkyl group, an alkoxy group, an alkoxycarbonyl group, an alkylthio group, an alkylsulfonyl group, an amino group, an alkylamino group, an arylamino group, a sulfonamido group, an aryloxy group or an arylthio group, more preferably an alkyl group having 1 to 8 carbon atoms or an hydroxyl group. x represents an integer of 0 to 6, and is preferably an integer of 0 to 3, more preferably an integer of 1 or 2. $R^B$ and $R^C$ each independently represent an acyl group, an alkoxycarbonyl group or a carbamoyl group.

Those groups having an alkyl moiety, an aryl moiety or a heterocyclic moiety as a partial structure among the groups descried above, may further have other substituents. Examples of those substituents include ones a ring A, $R^1$ and $R^2$ in formula (Y3) to be hereinafter described may have.

Preferable examples of the compound represented by formula (Y2) are shown below, but the compounds that can be used in the present invention are not limited to the following specific examples.

Y2-1

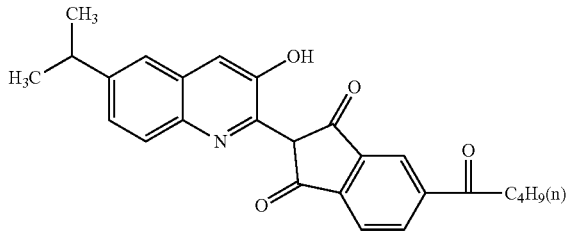

Y2-2

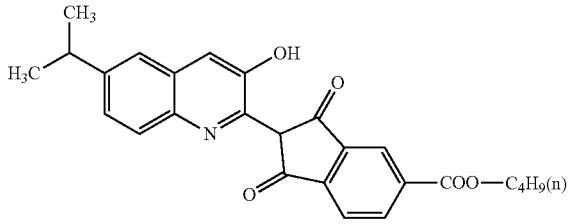

Y2-3

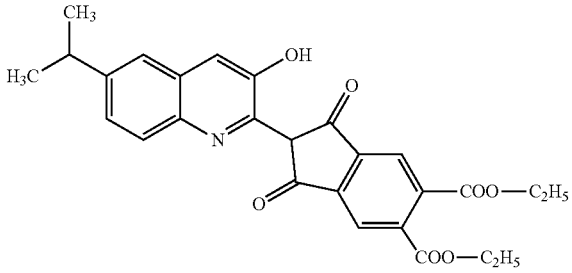

Next, the dye represented by formula (Y3) is explained in detail below.

Formula (Y3)

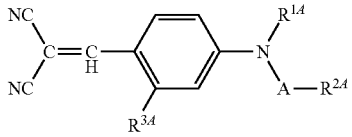

In formula (Y3), $R^{1A}$ represents an allyl group or an alkyl group; $R^{2A}$ represents a substituted or unsubstituted alkyl or aryl group, or an acyl group; A represents —$CH_2$—, —$CH_2CH_2$—, —$CH_2CH_2O$—, —$CH_2CH_2OCH_2$—, or —$CH_2CH_2OCH_2CH_2$—; and $R^{3A}$ represents a hydrogen atom or an alkyl group. Each group may further be substituted (for example, with a cycloalkyl group, an alkoxy group, acyloxy group or an hydroxyl group).

Preferable examples of the compound represented by formula (Y3) are shown below, but the compounds that can be used in the present invention are not limited to the following specific examples.

Y3-1

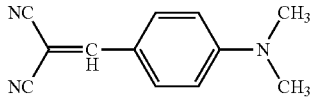

Y3-2

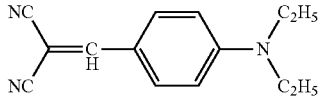

Y3-3

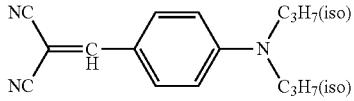

Y3-4

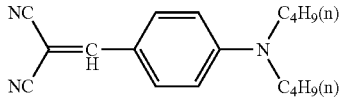

Y3-5

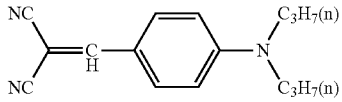

Y3-6

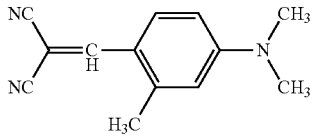

Y3-7

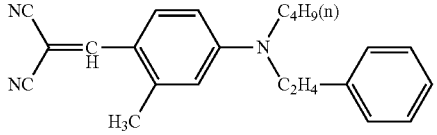

Y3-8

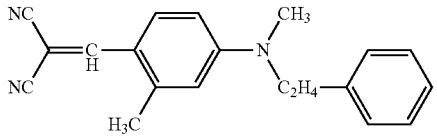

-continued

Y3-9

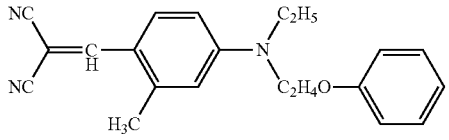

Y3-10

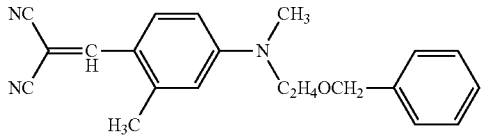

Y3-11

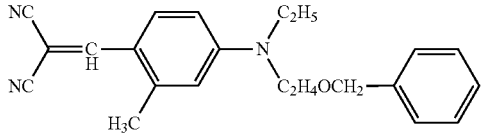

Y3-12

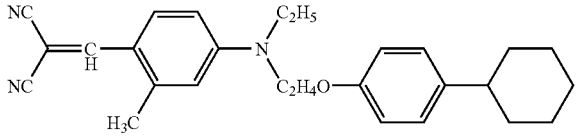

Y3-13

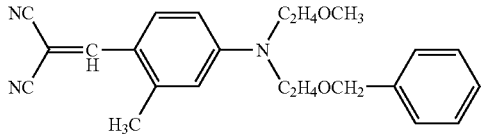

Y3-14

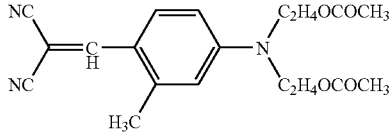

Next, the dye represented by formula (Y4) is explained in detail below.

Formula (Y4)

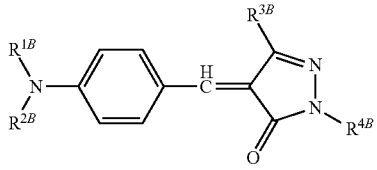

In formula (Y4), $R^{1B}$, $R^{2B}$, $R^{3B}$, and $R^{4B}$ each independently represent a hydrogen atom, an alkyl group, an aryl group, an alkoxy group or an alkylamino group.

Preferable examples of the compound represented by formula (Y4) are shown below, but the compounds that can be used in the present invention are not limited to the following specific examples.

Y4-1

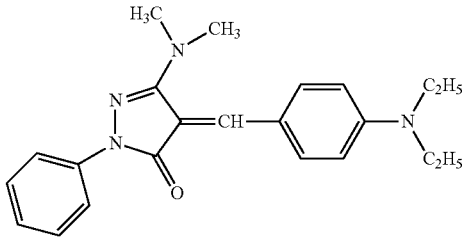

Y4-2

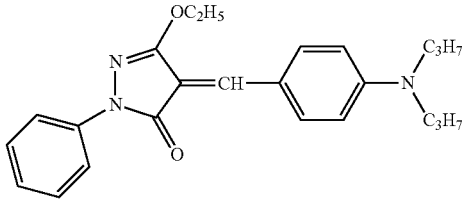

Y4-3

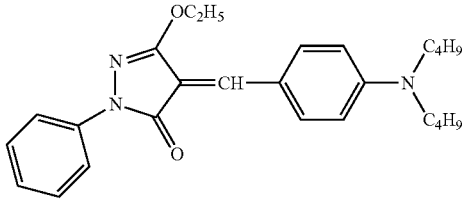

The dyes represented by formula (Y2), (Y3), or (Y4) can be synthesized according to a known method.

In the heat transfer layer of the ink sheet that is used in the present invention, use can be made of dyes that have been usually employed as a magenta dye. Among these, at least one magenta dye represented by any one of formulae (M1) to (M5) is preferably used. However, the magenta dye that can be used in the present invention is not limited to these dyes.

First, the compound represented by formula (M1) is explained below.

Formula (M1)

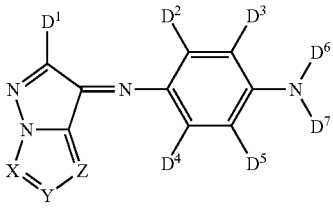

In formula (M1), $D^1$, $D^2$, $D^3$ $D^4$, and $D^9$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^6$ and $D^7$ each independently represent a hydrogen atom, an alkyl group, alkylcyano group or an aryl group; $D^6$ and $D^7$ may be bonded together to form a ring; $D^3$ and $D^6$ and/or $D^4$ and $D^7$ may be bonded together to form a ring; X, Y, and Z each independently represent $=C(D^8)$- or a nitrogen atom, in which $D^8$ represents a hydrogen atom, an alkyl group, an aryl group, an alkoxy group, an aryloxy group, or an amino group; when X and Y each represents $=C(D^8)$- or Y and Z each represents $=C(D^8)$-, two $D^8$s may be bonded together to form a saturated or unsaturated carbon ring; and each of the above-mentioned groups may further be substituted.

Among the dyes represented by formula (M1), dyes represented by formula (M1B) are preferable.

Formula (M1B)

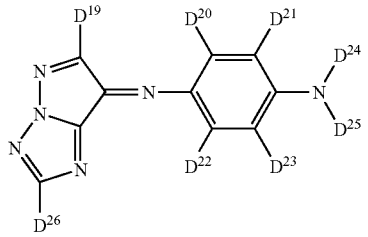

In formula (M1B), $D^{19}$, $D^{20}$, $D^{21}$, $D^{22}$, and $D^{23}$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group. $D^{24}$ and $D^{25}$ each independently represent a hydrogen atom, an alkyl group, an alkylcyano group or an aryl group. $D^{24}$ and $D^{25}$ may be bonded together to form a ring. $D^{21}$ and $D^{24}$ and/or $D^{22}$ and $D^{25}$ may be bonded together to form a ring. $D^{26}$ represents a hydrogen atom, a halogen atom, an alkyl group, an alkoxy group, an aryl group, or an amino group. Each of the above-mentioned groups may further be substituted.

Preferable examples of the dyes represented by formula (M1) are shown below, but the dyes that can be used in the present invention are not limited to the following specific examples.

M1-1

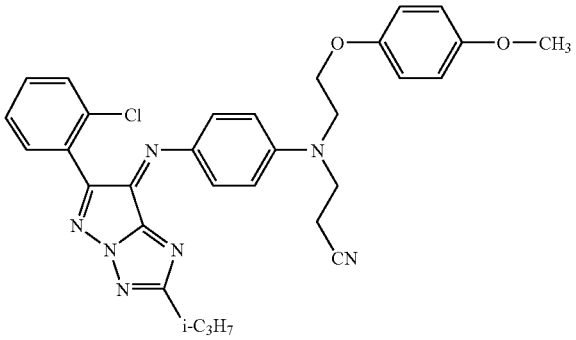

M1-2

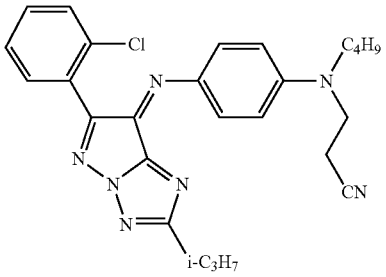

-continued

M1-3

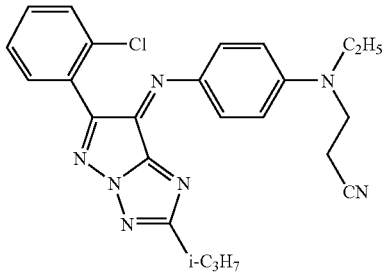

M1-4

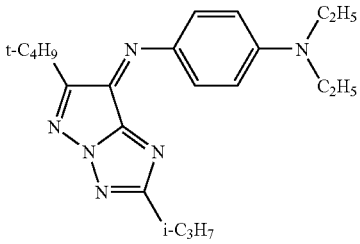

M1-5

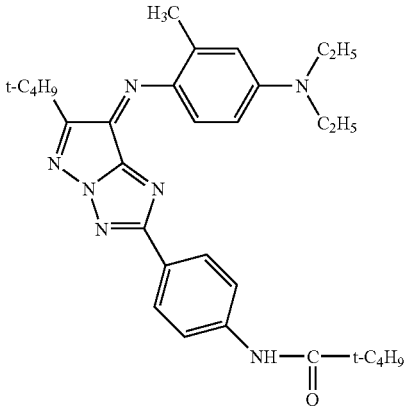

M1-6

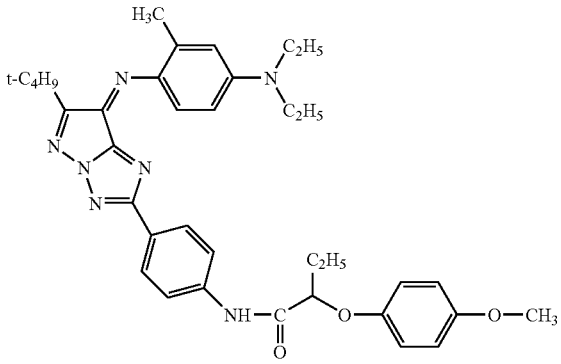

-continued

M1-7

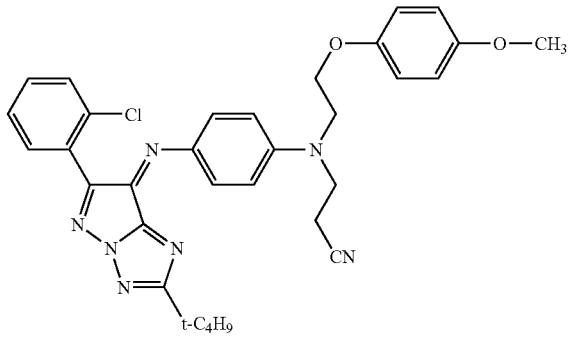

Next, the dye represented by formula (M2) is explained in detail below.

A-N=N-E Formula (M2)

In formula (M2), A represents an optionally substituted heterocyclic group whose hetero ring is selected from imidazole, pyrrazole, thiazole, benzothiazole, isothiazole, benzoisothiazole, and thiophene. Preferred heterocyclic rings are an imidazoyl group, a pyrazolyl group, a thiazolyl group, a benzothiazolyl group, an isothiazolyl group, a benzoisothiazolyl group, or a thienyl group. Of these substituents, preferred is an imidazoyl group. Each of them may further be substituted.

Examples of the substituent with which the heterocyclic group in A may be substituted include a cyano group, a thiocyano group, a nitro group, a halogen atom, an alkyl group, an alkoxy group, a formyl group, an alkylthio group, an alkylsulfonyl group, an alkoxycarbonyl group, and an alkylcarbonyl group. Of these substituents, preferred are a cyano group, a thiocyano group, a cyanomethyl group, a nitro group, and alkyl group.

E represents an optionally substituted aminophenyl group, tetrahydroquinolinyl group, yulolidyl group, or aminoquinolinyl group. Herein, the amino moiety in the aminophenyl group and the aminoquinolinyl group embraces an amino group and a substituted amino group. Examples of the substituent with which F may be substituted include an alkyl group, an alkenyl group, a cycloalkyl group, an aryl group, an amide group, and a heterocyclic group.

E is preferably an aminophenyl group which is substituted with an alkyl group, an amide group.

Preferable examples of the dye represented by formula (M2) are shown below, but the dyes that can be used in the present invention are not limited to the following specific examples.

M2-1

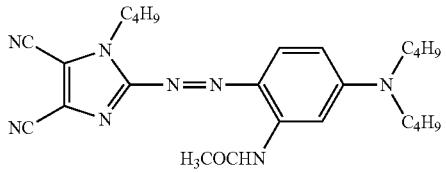

-continued

M2-2

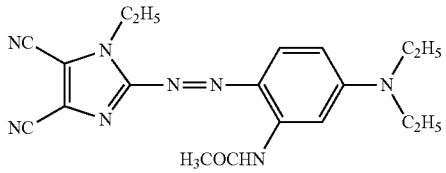

M2-3

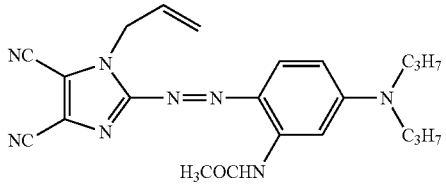

M2-4

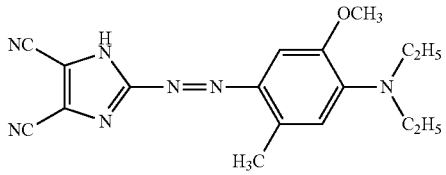

M2-5

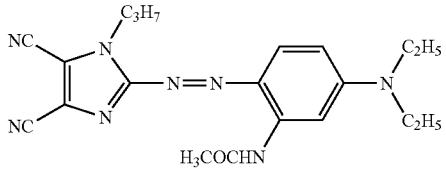

M2-6

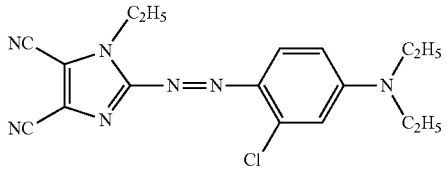

M2-7

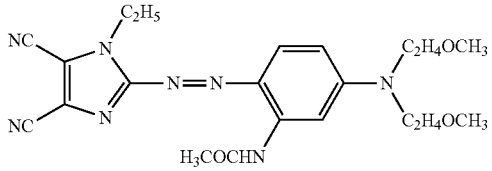

Next, the dye represented by formula (M3) or (M4) is explained in detail.

Formula (M3)

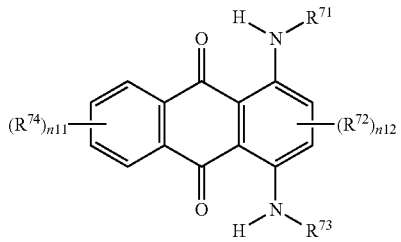

-continued

Formula (M4)

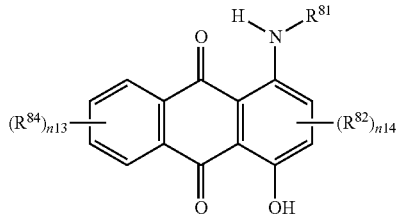

In formula (M3), $R^{71}$ and $R^{73}$ each independently represent a hydrogen atom or a substituent; $R^{72}$ and $R^{74}$ each independently represent a substituent; n11 represents an integer of 0 to 4; n12 represents an integer of 0 to 2; when n11 represents an integer of 2 to 4, $R^{74}$s may be the same or different from each other; and when n12 represents 2, $R^{72}$s may be the same or different from each other. Examples of the substituents represented by $R^{71}$ to $R^{74}$ include a halogen atom, an alkyl group (including a cycloalkyl group regardless of ring number), an alkenyl group (including a cycloalkenyl group regardless of ring number), an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group (including an alkylamino group and an anilino group), an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group. Each of the above-mentioned substituents may further be substituted.

Examples of the substituents represented by $R^{71}$ and $R^{73}$ include a hydrogen atom, a substituted or unsubstituted alkyl group, a substituted or unsubstituted alkenyl group, a substituted or unsubstituted aryl group, or a substituted or unsubstituted heterocyclic group; more preferably a hydrogen atom or a substituted or unsubstituted alkyl group, further preferably a hydrogen atom or a substituted or unsubstituted alkyl group having 1 to 6 carbon atoms, and still more preferably a hydrogen atom.

Examples of the substituents represented by $R^{72}$ and $R^{74}$ include a halogen atom, an alkyl group, an alkenyl group, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group or a carbamoyl group; more preferably an alkoxy group, an aryloxy group, an acyloxy group, a carbamoyloxy group, an alkoxycarbonyloxy group, or an aryloxycarbonyloxy group; more preferably an alkoxy group or an aryloxy group. Each of the above-mentioned substituents may further be substituted.

In formula (M4), $R^{81}$ represents a hydrogen atom or a substituent, $R^{82}$ and $R^{84}$ each independently represent a substituent, n13 represents an integer of 0 to 4, and n14 represents an integer of 0 to 2. When n13 represents an integer of 2 to 4, $R^{84}$s may be the same or different from each other. When n14 represents 2, $R^{82}$s may be the same or different from each other. Examples of the substituents each represented by $R^{81}$, $R^{82}$ and $R^{84}$ include those given as examples of the substituent each represented by $R^{71}$ to $R^{74}$ set forth above.

Examples of the substituent represented by $R^{81}$ include those given as examples of the substituents as described about $R^{71}$ and $R^{73}$, and preferable examples thereof are also the same. $R^{81}$ is preferably a hydrogen atom or a substituted or unsubstituted alkyl group having 1 to 6 carbon atoms, and preferably a hydrogen atom.

Examples of the substituent represented by $R^{82}$ and $R^{84}$ include those given as examples of the substituent as described about $R^{72}$ and $R^{74}$. $R^{82}$ and $R^{84}$ each independently are preferably an alkoxy group, an aryloxy group, an acyloxy group, a carbamoyloxy group, an alkoxycarbonyloxy group and an aryloxycarbonyloxy group; and preferably an alkoxy group and an aryloxy group. Each of these groups may be further substituted.

The following is an explanation about a preferable combination of various substituents that a dye represented by formula (M3) or (M4) may have: A preferred compound is a compound in which at least one of the substituents is the above-described preferable substituent. A more preferred compound is a compound in which more substituents are the above-described preferable substituents. The most preferred compound is a compound in which all substituents are the above-described preferable substituents.

In the compound represented by formula (M3), it is preferable that $R^{71}$ is a hydrogen atom, $R^{72}$ is an aryloxy group, $R^{73}$ is a hydrogen atom, n11 is an integer of 0, and n12 is an integer of 0 to 2. It is more preferable that $R^{71}$ is a hydrogen atom, $R^{72}$ is an aryloxy group, $R^{73}$ is a hydrogen atom, n11 is integer of 0, and n12 is an integer of 2.

In the compound represented by formula (M4), it is preferable that $R^{81}$ is a hydrogen atom, $R^{82}$ is an aryloxy group, n13 is an integer of 1 to 2, and n14 is an integer of 0. It is more preferable that $R^{81}$ is a hydrogen atom, $R^{82}$ is an aryloxy group, n13 is an integer of 1, and n14 is an integer of 0. It is further preferable that $R^{81}$ is a hydrogen atom, $R^{82}$ is an aryloxy group, n13 is an integer of 1, n14 is an integer of 0, and said $R^{82}$ is positioned at ortho-site to the amino group.

Preferable examples of the dye represented by formula (M3) or (M4) are shown below, but the dyes that can be used in the present invention are not limited to the following specific examples.

M3-1

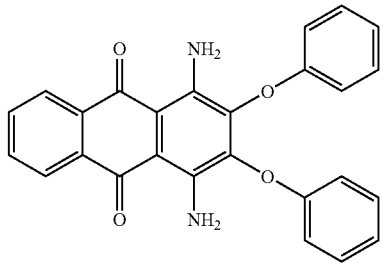

-continued

M3-2

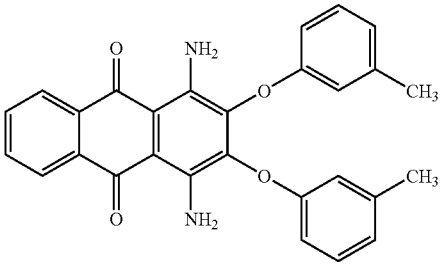

M3-3

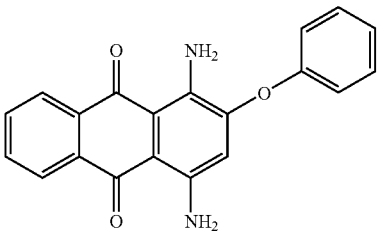

M3-4

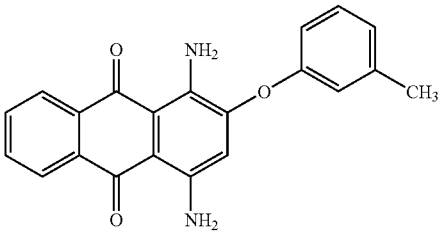

M4-1

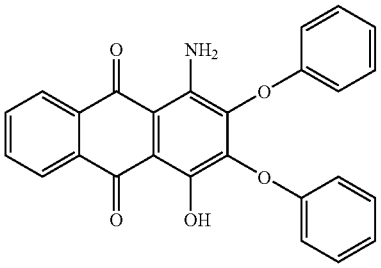

M4-2

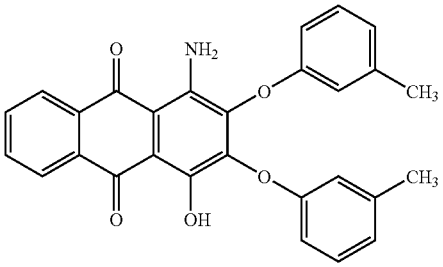

M4-3

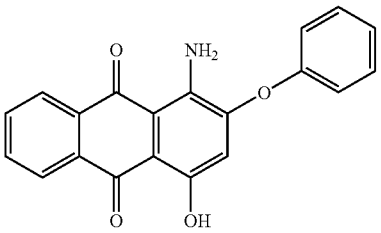

-continued

M4-4

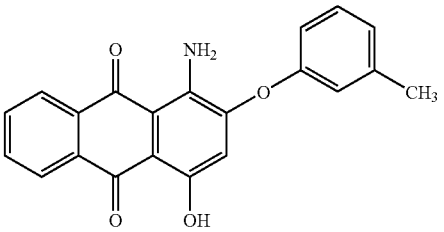

Next, the dye represented by formula (MS) is explained in detail

Formula (M5)

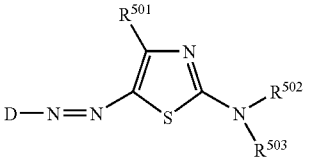

In formula (M5), $R^{501}$ represents a hydrogen atom, an alkyl group (preferably an alkyl group having 1 to 15 carbon atoms, which may have a phenyl or phenoxy group as a substituent), a cycloalkyl group (preferably a cyclohexyl group, which may further be substituted by any one of an alkyl group having 1 to 5 carbon atoms, an alkoxy group having 1 to 5 carbon atoms, and a halogen atom), an aryl group (preferably a phenyl group, which may further be substituted by any one of an alkyl group having 1 to 5 carbon atoms, an alkoxy group having 1 to 5 carbon atoms, a sulfonamido group and a halogen atom), or a heterocyclic group (preferably a thienyl group, a furanyl group or a pyridyl group, each of which may further be substituted by any one of an alkyl group having 1 to 5 carbon atoms, and a halogen atom).

$R^{502}$ and $R^{503}$ each represent a hydrogen atom, an alkyl group (preferably an alkyl group having 1 to 15 carbon atoms, which may be non-substituted or substituted with any one of a phenyl group, an alkylphenyl group wherein the alkyl moiety has 1 to 4 carbon atoms, an alkoxyphenyl group wherein the alkoxy moiety has 1 to 4 carbon atoms, a halogenated phenyl group, a benzyloxy group, an alkylbenzyloxy group wherein the alkyl moiety has 1 to 4 carbon atoms, an alkoxybenzyloxy group wherein the alkoxy moiety has 1 to 4 carbon atoms, a halogenated benzyloxy group, a halogen atom, a hydroxyl group, and a cyano group), an alkoxy group (preferably an alkoxy group having 1 to 15 carbon atoms, which is substituted with any one of a phenyl group, an alkylphenyl group whose alkyl moiety has 1 to 4 carbon atoms; an alkoxyphenyl group whose alkoxy moiety has 1 to 4 carbon atoms; a halogenated phenyl group, a benzyloxy group, an alkylbenzyloxy group whose alkyl moiety has 1 to 4 carbon atoms; an alkoxybenzyloxy group whose alkoxy moiety has 1 to 4 carbon atoms; a halogenated benzyloxy group, a halogen atom, a hydroxyl group, and a cyano group), a cycloalkyl group (preferably a cyclohexyl group, which may further be substituted by any one of an alkyl group having 1 to 15 carbon atoms, an alkoxy group having 1 to 15 carbon atoms, and a halogen atom), or an aryl group (preferably a phenyl group, which may further be substituted by an alkyl groups having 1 to 15 carbon atoms, an alkoxy group having 1 to 15 carbon atoms, a benzyloxy group, and a halogen atom).

D represents an optionally substituted aryl group (preferably an aryl group having 6 to 20 carbon atoms, more preferably an optionally substituted phenyl group), or an optionally substituted heterocyclic group (preferably a 5- to 8-membered heterocyclic group containing oxygen, sulfur or nitrogen as a ring-forming atom; said hetero ring may be an aliphatic ring or an aromatic ring, and may be condensed; more preferred are aromatic heterocyclic groups).

Examples of the substituent with which each of the groups of D may be substituted include a halogen atom, a nitro group, a cyano group, an alkyl group, an alkoxy group, an oxycarbonyl group, a carbamoyl group, a sulfonyl group, and a sulfonamido group.

Preferable examples of D include non-substitution, or a an aniline derivative, an aminothiophene derivative, an aminobenzisothiazole derivative, an aminothiazole derivative, an aminoisothiazole derivative, an aminopyrrole derivative, and an aminoisothiadiazole derivative, each of which is non-substituted or substituted with a halogen atom, a nitro group, a cyano group, an alkyl group, an alkoxy group, an oxycarbonyl group, a carbamoyl group, a sulfonyl group, or a sulfonamido group.

Preferable examples of the compound represented by formula (M5) are shown below, but the compounds that can be used in the present invention are not limited to the following specific examples.

The dye represented by any one of formulae (M1) to (M5) can be synthesized according to a usual manner.

In the heat transfer layer of the ink sheet that is used in the present invention, use can be made of dyes that have been usually employed as a cyan dye. Among these, at least one cyan dye represented by formula (C1) or (C2) is preferably used. However, the cyan dye that can be used in the present invention is not limited to these dyes.

First, the dye represented by formula (C1) is explained in detail.

Formula (C1)

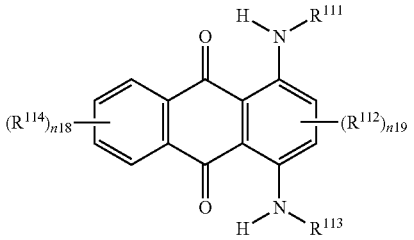

In formula (C1), $R^{111}$ and $R^{113}$ each independently represent a hydrogen atom or a substituent. $R^{112}$ and $R^{114}$ each independently represent a substituent; n18 represents an integer of 0 to 4; n19 represents an integer of 0 to 2. When n18 represents an integer of 2 to 4, $R^{114}$s may be the same or different from each other, and when n19 represents 2, $R^{112}$s may be the same or different from each other; each of these groups may further be substituted. Examples of the substituents represented by $R^{111}$ to $R^{114}$ include a halogen atom, an alkyl group, an alkenyl group, an alkynyl group, an aryl group, a heterocyclic group, an alkoxy group, an aryloxy group, a formyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group.

Examples of the substituent represented by $R^{111}$ and $R^{112}$ include a hydrogen atom, a substituted or unsubstituted alkyl group, a substituted or unsubstituted alkenyl group, a substituted or unsubstituted aryl group, and a substituted or unsubstituted heterocyclic group. $R^{112}$ and $R^{113}$ each independently are preferably a hydrogen atom, a substituted or unsubstituted alkyl group having 1 to 6 carbon atoms, or a substituted or unsubstituted aryl group.

Examples of the substituent represented by $R^{112}$ and $R^{114}$ include a halogen atom, an alkyl group, an alkenyl group, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or aryl-sulfonylamino group, an alkylthio group, an sulfamoyl group, an alkyl- or aryl-sulfinyl group, an alkyl- or aryl-sulfonyl group, an acyl group, an aryloxycarbonyl group, an alkoxycarbonyl group, and a carbamoyl group. $R^{112}$ and $R^{114}$ each independently are more preferably a hydrogen atom, a halogen atom, an alkyl group, an alkenyl group, an aryl group, a heterocyclic group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, an alkylthio group, an acyl group, an aryloxycarbonyl group, an alkoxycarbonyl group, or carbamoyl group, further preferably a halogen atom, a substituted or unsubstituted alkyl group, a substituted or unsubstituted alkenyl group, a substituted or unsubstituted aryl group, or a substituted or unsubstituted heterocyclic group; and further more preferably a substituted or unsubstituted alkyl group.

Preferable examples of the dye represented by formula (C1) are shown below, but the dyes that can be used in the present invention are not limited to the following specific examples.

C1-1

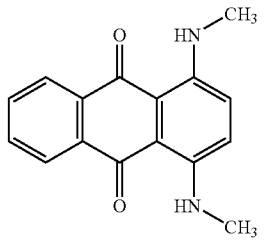

C1-2

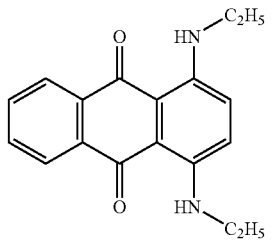

-continued

C1-3

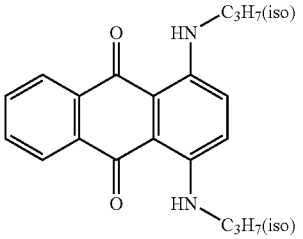

C1-4

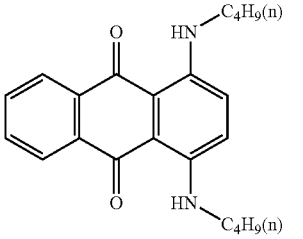

C1-5

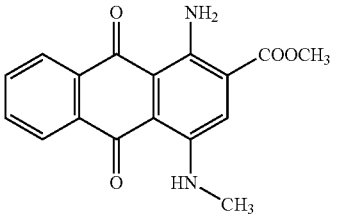

C1-6

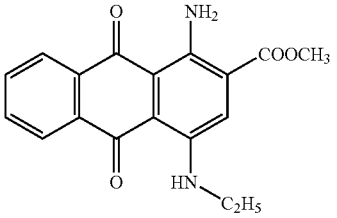

C1-7

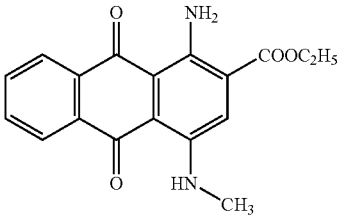

C1-8

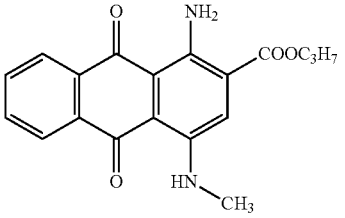

C1-9

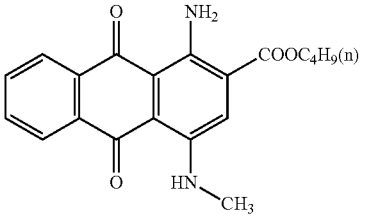

-continued

C1-10

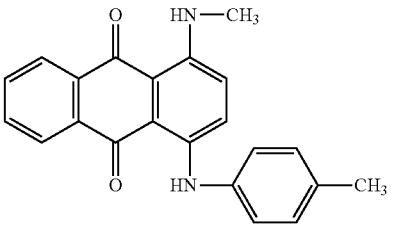

C1-11

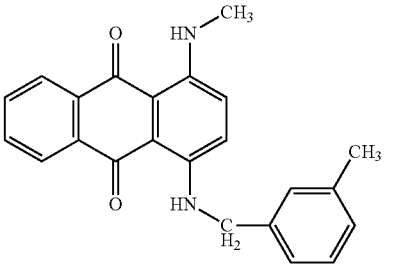

C1-12

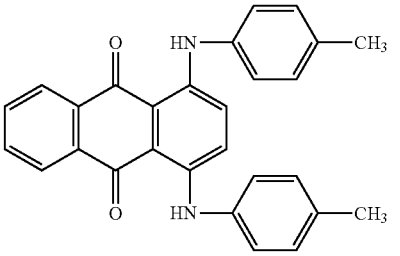

Among the dyes represented by the above-described formula (C1), those not commercially available can be synthesized according to the methods described in publications or specifications of U.S. Pat. Nos. 4,757,046 and 3,770,370, German Patent No. 2316755, JP-A-2004-51873, JP-A-7-137455, and JP-A-61-31292, and J. Chem. Soc. Perkin. Transfer I, 2047 (1977), *Merocyanine Dye-Doner Element Used in thermal Dye Transfer*, authored by Champan.

Next, the dye represented by formula (C2) is explained in detail.

Formula (C2)

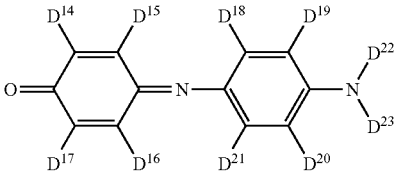

In formula (C2), $D^{14}$ to $D^{21}$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group or an amino group. $D^{22}$ and $D^{23}$ each independently represent a hydrogen atom, an alkyl group or an aryl group. $D^{22}$ and $D^{23}$ may be bonded together to form a ring. $D^{19}$ and $D^{22}$ and/or $D^{20}$ and $D^{23}$ may be bonded together to form a ring.

$D^{14}$ is preferably an acylamino group, a ureido group or an alkoxycarbonyl group, more preferably an acylamino group, or a ureido group, furthermore preferably an acylamino group, and most preferably a group represented by the following formula (IV).

$$—NH—C(=O)-D^{24} \qquad \text{Formula (IV)}$$

In formula (IV), $D^{24}$ is an alkyl group (preferably an alkyl group having 1 to 12 carbon atoms, e.g., methyl, ethyl, isopropyl, n-propyl, t-butyl), an aryl group (preferably an aryl group having 6 to 10 carbon atoms, e.g., phenyl, m-nitrophenyl, p-nitrophenyl, p-tolyl, p-methoxyphenyl, naphthyl, m-chlorophenyl, p-chlorophenyl) or a heterocyclic group (preferably a 5- to 8-membered heterocyclic group having 0 to 10 carbon atoms and containing, as a ring-constituting atom(s), a hetero atom selected from an oxygen atom, a nitrogen atom and a sulfur atom, e.g., pyridyl, furyl, tetrahydrofuryl). $D^{24}$ is preferably a heterocyclic group, and more preferably a pyridyl group, a furyl group, or a tetrahydrofuryl group.

$D^{15}$, $D^{16}$, $D^{18}$, $D^{19}$, $D^{20}$, and $D^{21}$ each are preferably a hydrogen atom or an alkyl group (preferably an alkyl group having 1 to 12 carbon atoms, e.g., methyl, ethyl, isopropyl, n-propyl, t-butyl), and more preferably a hydrogen atom, a methyl group or an ethyl group. $D^{17}$ is preferably a hydrogen atom, an alkyl group (preferably an alkyl group having 1 to 12 carbon atoms, e.g., methyl, ethyl, isopropyl, n-propyl, t-butyl), a halogen atom, a cyano group, a nitro group, or a heterocyclic group; and more preferably a hydrogen atom or a halogen atom. $D^{22}$ and $D^{23}$ each are preferably a hydrogen atom or an alkyl group (preferably an alkyl group having 1 to 12 carbon atoms, e.g., methyl, ethyl, isopropyl, n-propyl, t-butyl), and more preferably a methyl group, an ethyl group or an n-propyl group. These alkyl groups may be substituted with another substituent. In the case that the alkyl group is substituted with another substituent, preferable examples of the "another" substituent include a heterocyclic group, a halogen atom, an alkoxy group, an aryloxy group, an amino group, an acyl group, a acyloxy group, an acylamino group, an alkylthio group, an arylthio group, a sulfonylamino group, a sulfonyl group, a sulfinyl group, a carbamoyl group, a sulfamoyl group, an alkoxycarbonyl group and an aryloxycarbonyl group, with more preferable example being a carbamoyl group. $D^{22}$ and $D^{23}$ each are further preferably a hydrogen atom, a methyl group or an ethyl group.

Preferable examples of the dye represented by formula (C2) are shown below, but the dyes that can be used in the present invention are not limited to the following specific examples.

C2-1

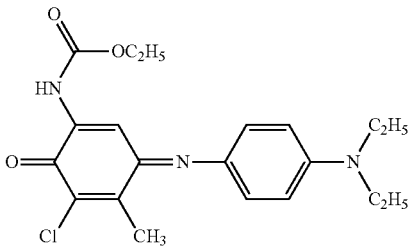

-continued

C2-2

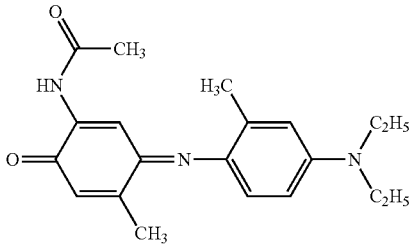

C2-3

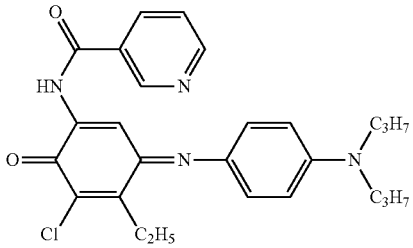

C2-4

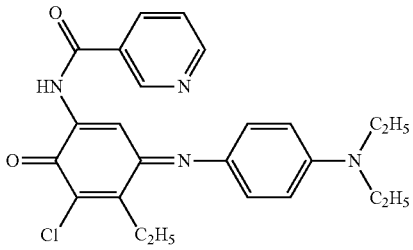

C2-5

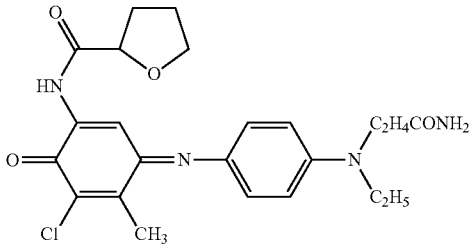

C2-6

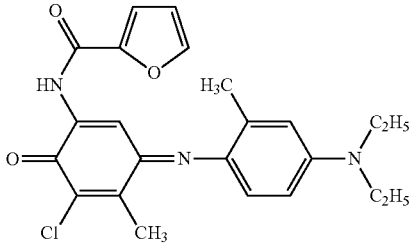

C2-7

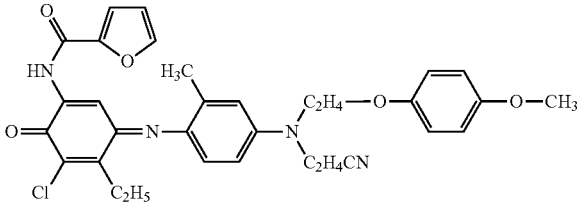

The dyes represented by formula (C2) can be synthesized according to a known method.

The dye ink can be prepared by dissolving or dispersing the above-described sublimation type dye and binder resin in a solvent. As the solvent that is used at the time of preparation, various kinds of known solvents can be used. Examples of the solvent include alcohol solvents such as methanol, ethanol, isopropyl alcohol, butanol, and isobutanol; ketone solvents such as methylethyl ketone, methylisobutyl ketone, and cyclohexanone; aromatic solvents such as toluene and xylene; and water. The solvents may be used singly, or as a mixture thereof.

In addition to the dye and the binder, various kinds of additives can be added to the heat transfer layer in order to improve various performances such as storage stability, traveling properties in a printer, and releasing properties after printing. As typical additives, organic or inorganic fine particles and waxes are preferably used.

As the organic particles, it is preferred to use fine particles of the resin exemplified by polyolefin resins such as polyethylene and polypropylene, fluorine resins, polyamide resins such as nylon resins, urethane resins, styrene-acryl series crosslinked resins, phenol resins, urea resins, melamine resins, polyimide resins, and benzoguanamine resins. Polyethylene fine particles are more preferably used. As the inorganic particles, it is preferred to use fine particles of, for example, calcium carbonate, silica, clay, talc, titanium oxide, magnesium hydroxide, or zinc oxide.

The organic or inorganic fine particles are preferably contained in a range of from 0.5 to 5% by mass, based on the binder resin of the heat transfer layer.

It is also a preferable embodiment that a wax is contained to the heat transfer layer in addition to the above-described sublimation type dye, binder, and organic or inorganic fine particles. As the wax that can be used, preferred are waxes derived from petroleum such as microcrystalline wax and paraffin wax; waxes derived from mineral such as montan wax; waxes derived from plants such as carnauba wax, Japan wax and candelilla wax; waxes derived from animals such as bees wax, spermaceti, insect wax and shellac wax; synthetic waxes such as Fischer-Tropsch wax, various kinds of low molecular polyethylene, aliphatic acid esters, aliphatic acid amides and silicone wax and partially modified waxes.

Next, explained is a composition of the heat-sensitive transfer sheet that is used in the present invention.

The heat-sensitive sheet of the present invention has at least one heat transfer layer (dye layer or pigment layer) containing at least one dye, which is disposed on one surface of the support, and the heat transfer layer is formed by applying a coating liquid for heat transfer layer.

(Support)

As the support, any one of previously known materials can be used, so far as such the material has both a heat resistance and a mechanical strength necessary to the requirements for the support. Specific examples of preferable supports include thin papers such as a glassine paper, a condenser paper, and a paraffin paper; high-temperature resistant polyesters such as polyethyleneterephthalate, polyethylenenaphthalate, polybutyleneterephthalate, polyphenylene sulfide, polyetherketone, and polyethersulfone; stretched or unstretched films of plastics such as polypropylene, polycarbonate, cellulose acetate, polyethylene derivatives, poly(vinyl chloride), poly(vinylidene chloride), polystyrene, polyamide, polyimide, polymethylpentene, and ionomers; and laminates of these materials. Of these materials, polyester films are especially preferred. Stretched polyester films are most preferred. A thickness of the support can be properly determined in accordance with the material of the support so that the mechanical strength and the heat resistance become optimum. Specifically, it is preferred to use a support having a thickness of about 1 μm to about 100 μm, more preferably from about 2 μm to about 50 μm, and further preferably from about 3 μm to about 10 μm.

It is essential in the sublimation type heat-sensitive transfer recording system that only dye(s) having each hue that is contained in a heat-sensitive transfer sheet must be transferred at the time of printing. Transfer of a resin carrying the dye is not preferred. Therefore, a strong adhesion between a heat transfer layer and a support of the heat-sensitive transfer sheet is required. If the adhesion is weak, the heat transfer layer in itself adheres to a heat-sensitive image-receiving sheet, thereby resulting in deterioration of image quality of printing.

However, in the case of the support such as a polyester film exemplified above as a preferable support, wettability of the ink with each hue as described later is not so sufficient that adhesive strength occasionally lacks.

In order to deal with such the problem, it is preferred to employ a method of physically treating a surface of the support, and/or a method of forming an easy adhesion layer.

It is preferred to form an easy adhesion layer composed of a resin on a support and to dispose a heat transfer layer on the easy adhesion layer. As a resin for forming the easy adhesion layer, there can be used, for example, urethane resins, polyester resins, polypropylene resins, polyol resins, acrylic resins, and reaction products of these resins and isocyanate compounds. Examples of the isocyanate compounds include diisocyanate compounds and triisocyanate compounds, each of which is conventionally used. A coating amount of the resin preferably ranges from 0.05 $g/m^2$ to 0.1 $g/m^2$.

In the production of the heat-sensitive transfer sheet, a support on which an easy adhesion layer is disposed in advance can be used, and a heat transfer layer can be formed on the said support.

(Coating Method for the Heat Transfer Layer)

The heat transfer layer that is used in the present invention is formed by applying a coating liquid (an ink) for the heat transfer layer on a support using a gravure printing method or other forming means, followed by drying. The ink for heat transfer layer is obtained by dissolving or dispersing a sublimation type dye, a binder resin and optionally additives such as organic or inorganic finely divided powder and waxes in a proper solvent.

A thickness of the heat transfer layer is preferably in the range of from about 0.2 $g/m^2$ to about 5 $g/m^2$, more preferably from about 0.4 $g/m^2$ to about 2 $g/m^2$ at the dry state. A content of the sublimation type dye in the heat transfer layer is preferably in the range of from 5% by mass to 90% by mass, more preferably from about 10% by mass to about 70% by mass.

Figure 2:
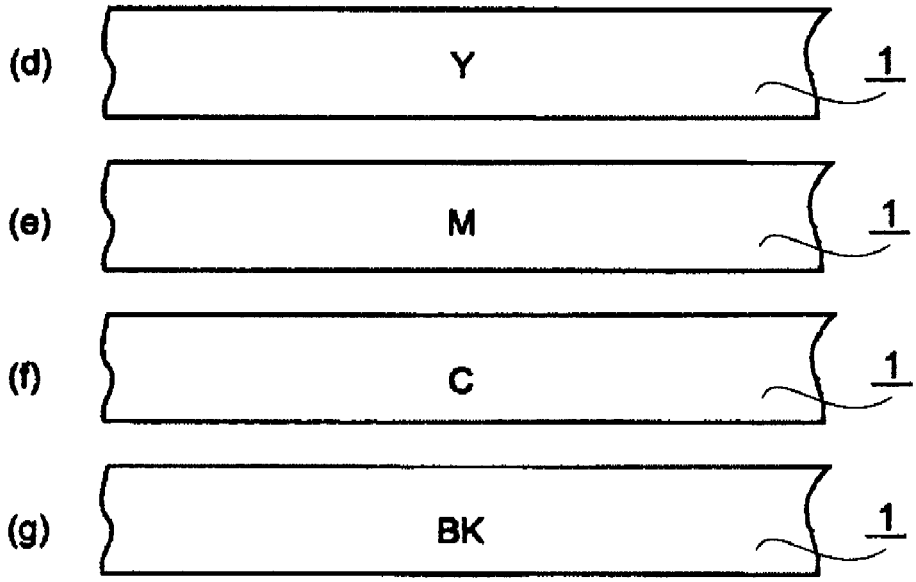
FIG. 2 shows an example of a heat transfer layer (a dye layer) disposed on separate supports of the present invention.
Figure 3:
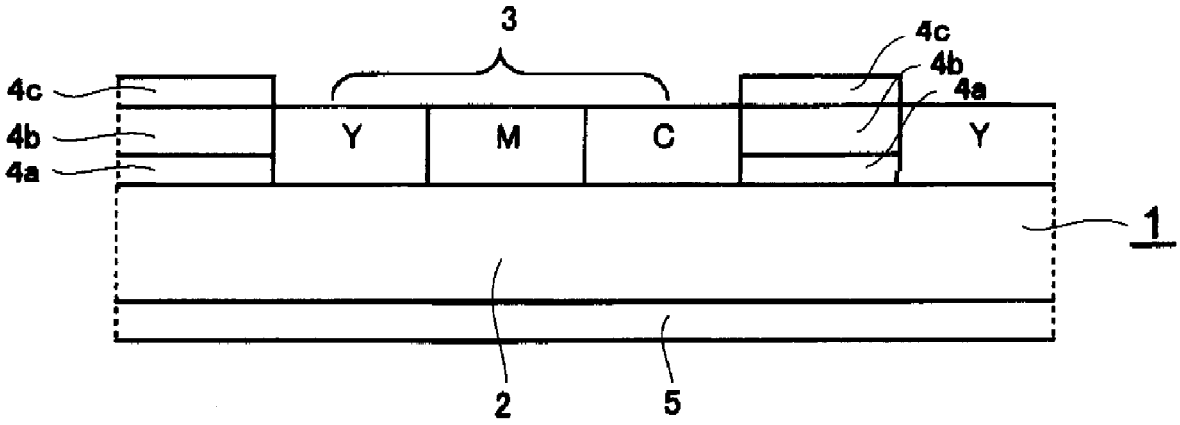
FIG. 3 shows a cross-sectional view of an example of a heat transfer layer of the preset invention

FIGS. 1(*a*) to (*c*) show examples of the heat-sensitive transfer layer of the present invention. In FIGS. 1 to 3, 1 denotes a heat-sensitive transfer sheet.

The heat-sensitive transfer sheet of the present invention has a heat transfer layer containing at least one dye disposed on a support. It is an ordinary way that the yellow heat transfer layer, the magenta heat transfer layer, and the cyan heat transfer layer are formed sequentially in this order on the support.

The term "forming layers sequentially" as used herein means forming heat transfer layers each having a different hue and/or function layers in the longitudinal direction on the support of the heat-sensitive transfer sheet, by applying them separately in order. In other words, the term "forming layers sequentially" used herein means not a laminate of said layers but layers next to each other arranged or provided in the longitudinal direction on the support, which are obtained by repeating the following (a) and (b):

(a) forming a layer at an area on the support, and (b) forming another layer at adjacent area to the area formed in (a) on the support in the longitudinal direction on the support.

So it is preferred to dispose heat transfer layers with each hue sequentially in this order on the same support as shown in FIG. 1(*a*). In addition, a black layer may be further disposed as shown in FIG. (b). Further, a transferable protective layer laminate 4 is preferably disposed between each of ink layers 3 composed of Y, M, C and BK. However, arrangement of the heat transfer layers with each hue in the present invention is not limited to the above, but any arrangement can be employed in accordance with necessity.

Further, a releasing property between a heat-sensitive transfer sheet and a heat-sensitive image-receiving sheet and the like are changed depending on the printing order. Therefore, it is also a preferable embodiment to change a content of additives for use in each of the heat transfer layers in response to the change of releasing properties. For example, as a heat transfer layer is used later for printing, it is possible to increase a content of the releasing agent in the heat transfer layer.

FIG. 2 shows an example of a heat transfer layer (a dye layer) disposed on separate supports of the present invention. It is also possible to form each of heat transfer layers with each hue on a separate support, in place of disposing the heat transfer layers with each hue on the same support. The structure shown in FIG. 2 is indeed one example of such the composite layer structure.

FIG. 3 shows a cross-sectional view of an example of the heat transfer layer of the preset invention. As exemplified in FIG. 3, in the heat transfer layer of the preset invention, a releasing layer 4*a*, a protective layer 4*b* and an adhesive layer 4*c* can be formed on a support in this order from the support 2. The protective layer 4*b* may be formed by plural layers. In the case where the protective layer also has functions of other layers, the releasing layer 4*a* and the adhesive layer 4*c* can be omitted. It is also possible to use a support 2 on which an easy adhesive layer has already been formed. 3 and 5 respectively show ink layer and a back side layer. In the heat-sensitive transfer sheet that is used in the present invention, the heat transfer layer (the dye layer) and the protective layer may have a single layer structure, or a multilayer structure such as a double layer structure and a three or more layer structure. Further, as the heat transfer layers, a single layer structure and a multilayer structure may coexist in the transfer sheet. FIG. 3 shows one example of such the composite layer structure. Each of the yellow heat transfer layer, the magenta heat transfer layer and the cyan heat transfer layer has a single layer structure.

A total thickness of the heat transfer layers having a multilayer structure is preferably in the range of from about 0.2 $g/m^2$ to about 5 $g/m^2$, more preferably from about 0.4 $g/m^2$ to about 2 $g/m^2$. A thickness of one constituting layer of the heat transfer layer is preferably in the range of from about 0.2 $g/m^2$ to about 2 $g/m^2$. A total content of the sublimation type dye in the total heat transfer layers is preferably in the range of from 5% by mass to 90% by mass, more preferably from about 10% by mass to about 70% by mass.

2) Heat Transferable Protective Layer

A preferable embodiment of the present invention is that a heat transferable protective layer is disposed on the above-described heat-sensitive transfer sheet. The following is an explanation of the heat transferable protective layer.

(Fundamental Composition)

The heat transferable protective layer (hereinafter also referred to as "a heat-sensitive transfer cover film") is a heat-sensitive transfer cover film having a substrate and a transparent resin layer disposed thereon so that the transparent resin layer can be detached, and further a heat-sensitive adhesive layer disposed on the transparent resin layer. The heat-sensitive adhesive layer is preferably composed of a resin having a glass transition temperature of from 40° C. to 75° C. A releasing layer may be disposed between the substrate film and the transparent resin layer so as to reduce adhesion properties between the transparent resin layer and the substrate, thereby to make it easier to transfer the transparent resin layer. Further, a back layer may be disposed on the back side of the above-described substrate film to prevent a thermal head of a printer from sticking. As the substrate, the same materials as described above with respect to the heat-sensitive transfer sheet can be preferably used.

(Transparent Resin Layer)

The transparent resin layer disposed on the substrate may be composed of various kinds of resins that are excellent in abrasion resistance, chemical resistance, transparency, hardness and the like. Examples of the resin include polyester resins, polystyrene resins, acrylic resins, polyurethane resins, acrylurethane resins, silicone-modified resins of each of these resins, and a mixture of each of these resins. These resins are excellent in transparency, but tend to form a relatively stiff coating. Consequently, a so-called "film-off" at the time of transfer is not enough. Therefore, to these transparent resin layers, fine particles or wax having a high transparency, such as silica, alumina, calcium carbonate, and plastic pigments may be added in such an amount that transparency of the resin is not substantially degraded.

As a method of forming a transparent resin layer on a substrate, or on a previously formed releasing layer disposed on the substrate, there are various methods such as gravure coat, gravure reverse coat, roll coat, and a method of coating and drying an ink containing the above-described resin. A thickness of the transparent resin layer is preferably from 0.1 μm to about 20 μm.

At the time of forming the above-described transparent resin layer, various additives may be contained in said transparent resin layer. The additives are exemplified by a sliding agent, a ultraviolet absorber, an antioxidant and/or a fluorescent whitening agent. Addition of these additives enables to improve properties such as scratch resistance, gloss, light resistance, weather resistance and whiteness of various kinds of images to be laminated with the transparent resin layer.

(Releasing Layer)

The releasing layer that may be formed on the substrate prior to formation of the above-described transparent resin layer, is preferably formed of releasing agents such as waxes, silicone waxes, silicone resins, fluorine resins, or acrylic resins. The releasing layer may be formed in the same manner as the method of forming the above-described transparent resin layer. As a thickness of the releasing layer, a thickness in a range of from 0.05 μm to about 5 μm is generally sufficient. Further, in the case where it is preferred to dispose a matte protective layer after transfer, the surface can be made matte by incorporating various particles in a releasing layer or by using a substrate film having a matte processed surface on the same side as the releasing layer.

(Heat-Sensitive Adhesive Layer)

In order to improve transfer properties of the transparent resin layer and so on, a heat-sensitive adhesive layer is also disposed on the surface of said transparent resin layer. An ultraviolet absorber is preferably contained in the heat-sensitive adhesive layer. The heat-sensitive adhesive layer is formed by coating and drying a solution of a thermoplastic resin that has Tg of preferably from 40° C. to 75° C., more preferably from 60° C. to 70° C. and that is excellent in adhesiveness when heated, such as acrylic resins, polyvinylchloride resins, polyvinyl acetate resins, vinyl chloride-vinyl acetate copolymer resins and polyester resins. The heat-sensitive adhesive layer is preferably formed so as to become a thickness of from 0.1 μm to about 10 μm.

If the Tg value of the heat-sensitive adhesive layer is less than 40° C., adhesion properties between a transparent resin layer and an image laminated with the transparent resin layer sometimes becomes insufficient. Besides, in the case where the formed image is used at a relatively high temperature, fine cracks can sometimes generate in the transparent resin layer owing to softening of the adhesive layer, resulting in degradation of chemical resistance, particularly resistance to plasticizer. In contrast, if the Tg value of the heat-sensitive adhesive layer is more than 75° C., heating by a thermal head can sometimes be insufficient to give satisfactory transfer of the transparent protective layer; and "foil-off" properties (i.e. easiness of removing) of the transparent resin layer can sometimes degrade, resulting in difficulty of transfer with a good resolution.

Further, of the above-described heat-sensitive adhesives, especially preferred are polyvinylchloride resins, polyvinyl acetate resins, and vinyl chloride-vinyl acetate copolymer resins, each of which has a polymerization degree of from 50 to 300, more preferably from 50 to 250. If the polymerization degree is too low, there are sometimes caused the same disadvantages as the case where the Tg value is less than 50° C. In contrast, if the polymerization degree is too high, there are sometimes caused the same disadvantages as the case where the Tg value is more than 300° C.

The above description is of a composition of the heat-sensitive transfer cover film preferably used in the present invention. As a matter of cause, the transparent resin layer of the heat-sensitive transfer cover film may be disposed solely on a substrate, or may be disposed in a state where the transparent resin layer and the heat transfer layers containing respective diffusion transfer dyes according to the present invention are sequentially arranged in the longitudinal direction on the same support. In the latter case, the heat-sensitive transfer cover film becomes a part of the heat-sensitive transfer sheet according to the present invention.

<Ultraviolet Absorber>

In the present invention a more preferable embodiment of the heat-sensitive transfer cover film is that the heat-sensitive transfer cover film has an absorption in a near ultraviolet region of the wavelength ranging from 330 nm to 370 nm. This can be accomplished by introducing an ultraviolet absorber in a heat-sensitive transfer cover film.

The following explanation is of the ultraviolet absorbers preferably used in the present invention.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, after addition of the ultraviolet absorber to a receptor layer so as to form a heat-sensitive transfer image-receiving sheet, it is preferred that the resultant heat-sensitive transfer image-receiving sheet has the maximum absorption in the wavelength region of from 330 nm to 370 nm and has an absorption density Abs of 0.8 or more at the maximum absorption wavelength, more preferably has an absorption density Abs of 0.5 or more at 380 nm. Also, the heat-sensitive transfer image-receiving sheet has an absorption density of, preferably, Abs 0.1 or less at 400 nm. If the absorption density at a wavelength range exceeding 400 nm is high, it is not preferable because an image is made yellowish.

In the present invention, the ultraviolet absorber may be made to have a higher molecular weight. In this case, the ultraviolet absorber has a mass average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, the polymer containing a unit having ultraviolet absorbing ability (ultraviolet absorber unit) may be made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3450339 may be used. As the ultraviolet absorber to be used in a form of a latex, the following commercially available ultraviolet absorbers may be used which include ULS-700, ULS-1700, ULS-1383MA, ULS-1635 MH, XL-7016, ULS-933LP, and ULS-935LH (trade names, manufactured by Ipposha Oil Industries Co., Ltd.); and New Coat UVA-1025W, New Coat UVA-204W, and New Coat UVA-4512M (trade names, manufactured by Shin-Nakamura Chemical Co., Ltd.). (all of these names are trade names).

In the case of using the polymer containing a unit having ultraviolet absorbing ability in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the polymer containing a unit having ultraviolet absorbing ability or its latex is preferably 5 to 50 parts by mass, and more preferably 10 to 30 parts by mass, to 100 parts by mass of the receptor polymer capable of being dyed or its latex to be used to form the receptor layer.

The ultraviolet absorber may be either an organic compound or an inorganic compound.

In the case of the organic ultraviolet absorber, those represented by the following Formulae (1) to (8) are preferable.

The following is an explanation of the ultraviolet absorbers represented by any one of formulae (1) to (8).

Formula (1)

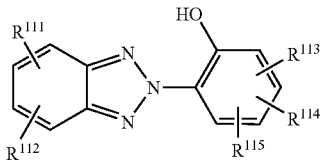

In formula (1), $R^{111}$, $R^{112}$, $R^{113}$, $R^{114}$, and $R^{115}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group.

Formula (2)

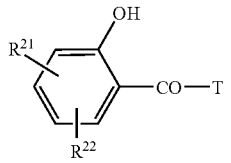

In formula (2), $R^{21}$ and $R^{22}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group. T represents an aryl group, a heterocyclic group, or an aryloxy group. T preferably represents an aryl group.

Formula (3)

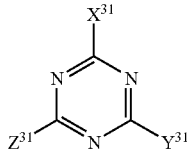

In the formula (3), $X^{31}$, $Y^{31}$ and $Z^{31}$ each independently represent a substituted or unsubstituted alkyl group, aryl group, alkoxy group, aryloxy group, alkylthio group, arylthio group or heterocyclic group. At least one of $X^{31}$, $Y^{31}$ and $Z^{31}$ represents a group represented by the following Formula (a).

Formula (a)

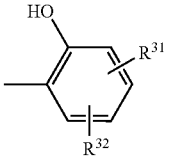

In formula (a), $R^{31}$ and $R^{32}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group. Also, the neighboring $R^{31}$ and $R^{32}$ may be combined to form a ring.

Formula (4)

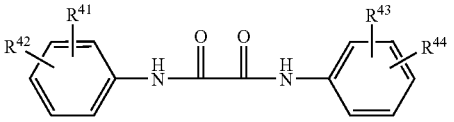

In formula (4), $R^{41}$, $R^{42}$, $R^{43}$, and $R^{44}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group.

Formula (5)

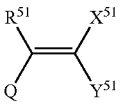

In the formula (5), Q represents an aryl group or a five- or six-membered heterocyclic group, $R^{51}$ represents a hydrogen atom or an alkyl group, $X^{51}$ and $Y^{51}$ each independently represent a cyano group, —$COOR^{52}$, —$CONR^{52}R^{53}$, —$COR^{52}$, —$SO_2OR^{52}$ or —$SO_2NR^{52}R^{53}$, wherein $R^{52}$ and $R^{53}$ each independently represent a hydrogen atom, an alkyl group or an aryl group. One among $R^{52}$ and $R^{53}$ preferably represents a hydrogen atom. Also, $X^{51}$ and $Y^{51}$ may be combined to form a five- or six-membered ring. When $X^{51}$ and $Y^{51}$ are respectively a carboxyl group, they may respectively have a salt form.

Formula (6)

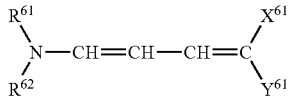

In the formula (6), $R^{61}$ and $R^{62}$ each independently represent a hydrogen atom, an alkyl group or an aryl group, or nonmetal atomic groups which are combined with each other to form a five- or six-membered ring. Also, any one of $R^{61}$ and $R^{62}$ may be combined with a methine group adjacent to the nitrogen atom to form a five- or six-membered ring. $X^{61}$ and $Y^{61}$ may be the same or different and have the same meanings as $R^{51}$ and $X^{51}$ in formula (5).

Formula (7)

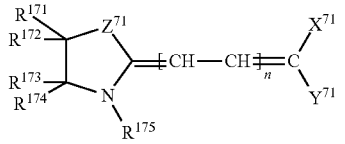

In the formula (7), $R^{71}$, $R^{72}$, $R^{73}$, and $R^{74}$ may be the same or different, and each independently represent a hydrogen atom, an alkyl group or an aryl group, provided that $R^{171}$ and $R^{174}$ may be combined with each other to form a double bond, wherein when $R^{171}$ and $R^{174}$ are combined with each other to form a double bond, $R^{172}$ and $R^{173}$ may be combined with each other to form a benzene ring or a naphthalene ring. $R^{175}$ represents an alkyl group or an aryl group, $Z^{71}$ represents an oxygen atom, a sulfur atom, a methylene group, an ethylene group, >N—$R^{176}$ or >C($R^{177}$)($R^{178}$), where $R^{176}$ represents an alkyl group or an aryl group, and $R^{177}$ and $R^{178}$ may be the same or different and respectively represent a hydrogen atom or an alkyl group. $X^{71}$ and $Y^{71}$ may be the same or different, and have the same meanings as $X^{51}$ and $Y^{51}$ in the formula (5). n denotes 0 or 1.

Formula (8)

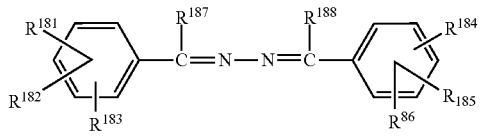

In formula (8), $R^{181}$, $R^{182}$, $R^{183}$, $R^{184}$, $R^{185}$, and $R^{186}$ each independently represent a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, or a silyl group; $R^{87}$ and $R^{88}$ may be the same or different and each represent a hydrogen atom, an alkyl group, or an aryl group, and $R^{187}$ and $R^{188}$ may bond together to form a 5- or 6-membered ring.

In the formulae (1) to (8) and (a), each substituent in, for example, groups having an alkyl part, aryl part or heterocyclic part may be substituted with the following substituents. In the explanations of each group described in the formulae (1) to (8) and (a), specific examples include exemplified groups of the corresponding groups among the groups shown below.

Such groups will be explained and exemplified hereinbelow.

Specific examples include: a halogen atom (e.g. a chlorine atom, a bromine atom, or an iodine atom); an alkyl group [which represents a substituted or unsubstituted linear, branched, or cyclic alkyl group, and which includes an alkyl group (preferably an alkyl group having 1 to 30 carbon atoms, e.g. a methyl group, an ethyl group, an n-propyl group, an isopropyl group, a t-butyl group, an n-octyl group, an eicosyl group, a 2-chloroethyl group, a 2-cyanoethyl group, or a 2-ethylhexyl group), a cycloalkyl group (preferably a substituted or unsubstituted cycloalkyl group having 3 to 30 carbon atoms, e.g. a cyclohexyl group, a cyclopentyl group, or a 4-n-dodecylcyclohexyl group), a bicycloalkyl group (preferably a substituted or unsubstituted bicycloalkyl group having 5 to 30 carbon atoms, i.e. a monovalent group obtained by removing one hydrogen atom from a bicycloalkane having 5 to 30 carbon atoms, e.g. a bicyclo[1,2,2]heptan-2-yl group or a bicyclo[2,2,2]octan-3-yl group), and a tricyclo or higher structure having three or more ring structures; and an alkyl group in substituents described below (e.g. an alkyl group in an alkylthio group) represents such an alkyl group of the above concept]; an alkenyl group [which represents a substituted or unsubstituted linear, branched, or cyclic alkenyl group, and which includes an alkenyl group (preferably a substituted or unsubstituted alkenyl group having 2 to 30 carbon atoms, e.g. a vinyl group, an allyl group, a prenyl group, a geranyl group, or an oleyl group), a cycloalkenyl group (preferably a substituted or unsubstituted cycloalkenyl group having 3 to 30 carbon atoms, i.e. a monovalent group obtained by removing one hydrogen atom from a cycloalkene having 3 to 30 carbon atoms, e.g. a 2-cyclopenten-1-yl group or a 2-cyclohexen-1-yl group), and a bicycloalkenyl group (which represents a substituted or unsubstituted bicycloalkenyl group, preferably a substituted or unsubstituted bicycloalkenyl group having 5 to 30 carbon atoms, i.e. a monovalent group obtained by removing one hydrogen atom from a bicycloalkene having one double bond, e.g. a bicyclo[2,2,1]hept-2-en-1-yl group or a bicyclo[2,2,2]oct-2-en-4-yl group)]; an alkynyl group (preferably a substituted or unsubstituted alkynyl group having 2 to 30 carbon atoms, e.g. an ethynyl group, a propargyl group, or a trimethylsilylethynyl group); an aryl group (preferably a substituted or unsubstituted aryl group having 6 to 30 carbon atoms, e.g. a phenyl group, a p-tolyl group, a naphthyl group, an m-chlorophenyl group, or an o-hexadecanoylaminophenyl group); a heterocyclic group (preferably a monovalent group obtained by removing one hydrogen atom from a substituted or unsubstituted 5- or 6-membered aromatic or nonaromatic heterocyclic compound; more preferably a 5- or 6-membered aromatic heterocyclic group having 3 to 30 carbon atoms, e.g. a 2-furyl group, a 2-thienyl group, a 2-pyrimidinyl group, a 2-benzothiazolyl group); a cyano group; a hydroxyl group; a nitro group; a carboxyl group; an alkoxy group (preferably a substituted or unsubstituted alkoxy group having 1 to 30 carbon atoms, e.g. a methoxy group, an ethoxy group, an isopropoxy group, a t-butoxy group, an n-octyloxy group, or a 2-methoxyethoxy group); an aryloxy group (preferably a substituted or unsubstituted aryloxy group having 6 to 30 carbon atoms, e.g. a phenoxy group, a 2-methylphenoxy group, a 4-t-butylphenoxy group, a 3-nitrophenoxy group, or a 2-tetradecanoylaminophenoxy group); a silyloxy group (preferably a silyloxy group having 3 to 20 carbon atoms, e.g. a trimethylsilyloxy group or a t-butyldimethylsilyloxy group); a heterocyclic oxy group (preferably a substituted or unsubstituted heterocyclic oxy group having 2 to 30 carbon atoms, e.g. a 1-phenyltetrazol-5-oxy group or a 2-tetrahydropyranyloxy group); an acyloxy group (preferably a formyloxy group, a substituted or unsubstituted alkylcarbonyloxy group having 2 to 30 carbon atoms, or a substituted or unsubstituted arylcarbonyloxy group having 7 to 30 carbon atoms, e.g. a formyloxy group, an acetyloxy group, a pivaloyloxy group, a stearoyloxy group, a benzoyloxy group, or a p-methoxyphenylcarbonyloxy group); a carbamoyloxy group (preferably a substituted or unsubstituted carbamoyloxy group having 1 to 30 carbon atoms, e.g. an N,N-dimethylcarbamoyloxy group, an N,N-diethylcarbamoyloxy group, a morpholinocarbonyloxy group, an N,N-di-n-octylaminocarbonyloxy group, or an N-n-octylcarbamoyloxy group); an alkoxycarbonyloxy group (preferably a substituted or unsubstituted alkoxycarbonyloxy group having 2 to 30 carbon atoms, e.g. a methoxycarbonyloxy group, an ethoxycarbonyloxy group, a t-butoxycarbonyloxy group, or an n-octylcarbonyloxy group); an aryloxycarbonyloxy group (preferably a substituted or unsubstituted aryloxycarbonyloxy group having 7 to 30 carbon atoms, e.g. a phenoxycarbonyloxy group, a p-methoxyphenoxycarbonyloxy group, or a p-n-hexadecyloxyphenoxycarbonyloxy group); an amino group (preferably an amino group, a substituted or unsubstituted alkylamino group having 1 to 30 carbon atoms, or a substituted or unsubstituted arylamino group having 6 to 30 carbon atoms, e.g. an amino group, a methylamino group, a dimethylamino group, an anilino group, an N-methyl-anilino group, or a diphenylamino group); an acylamino group (preferably a formylamino group, a substituted or unsubstituted alkylcarbonylamino group having 1 to 30 carbon atoms, or a substituted or unsubstituted arylcarbonylamino group having 6 to 30 carbon atoms, e.g. a formylamino group, an acetylamino group, a pivaloylamino group, a lauroylamino group, a benzoylamino group, or a 3,4,5-tri-n-octyloxyphenylcarbonylamino group); an aminocarbonylamino group (preferably a substituted or unsubstituted aminocarbonylamino group having 1 to 30 carbon atoms, e.g. a carbamoylamino group, an N,N-dimethylaminocarbonylamino group, an N,N-diethylaminocarbonylamino group, or a morpholinocarbonylamino group); an alkoxycarbonylamino group (preferably a substituted or unsubstituted alkoxycarbonylamino group having 2 to 30 carbon atoms, e.g. a methoxycarbonylamino group, an ethoxycarbonylamino group, a t-butoxycarbonylamino group, an n-octadecyloxycarbonylamino group, or an N-methyl-methoxycarbonylamino group); an aryloxycarbonylamino group (preferably a substituted or unsubstituted aryloxycarbonylamino group having 7 to 30 carbon atoms, e.g. a phenoxycarbonylamino group, a p-chlorophenoxycarbonylamino group, or an m-n-octyloxyphenoxycarbonylamino group); a sulfamoylamino group (preferably a substituted or unsubstituted sulfamoylamino group having 0 to 30 carbon atoms, e.g. a sulfamoylamino group, an N,N-dimethylaminosulfonylamino group, or an N-n-octylaminosulfonylamino group); an alkyl- or aryl-sulfonylamino group (preferably a substituted or unsubstituted alkylsulfonylamino group having 1 to 30 carbon atoms, or a substituted or unsubstituted arylsulfonylamino group having 6 to 30 carbon atoms, e.g. a methylsulfonylamino group, a butylsulfonylamino group, a phenylsulfonylamino group, a 2,3,5-trichlorophenylsulfonylamino group, or a p-methylphenylsulfonylamino group); a mercapto group; an alkylthio group (preferably a substituted or unsubstituted alkylthio group having 1 to 30 carbon atoms, e.g. a methylthio group, an ethylthio group, or an n-hexadecylthio group); an arylthio group (preferably a substituted or unsubstituted arylthio group having 6 to 30 carbon atoms, e.g. a phenylthio group, a p-chlorophenylthio group, or an m-methoxyphenylthio group); a heterocyclic thio group (preferably a substituted or unsubstituted heterocyclic thio group having 2 to 30 carbon atoms, e.g. a 2-benzothiazolylthio group or a 1-phenyltetrazol-5-ylthio group); a sulfamoyl group (preferably a substituted or unsubstituted sulfamoyl group having 0 to 30 carbon atoms, e.g. an N-ethylsulfamoyl group, an N-(3-dodecyloxypropyl)sulfamoyl group, an N,N-dimethylsulfamoyl group, an N-acetylsulfamoyl group, an N-benzoylsulfamoyl group, or an N—(N'-phenylcarbamoyl)sulfamoyl group); a sulfo group; an alkyl- or aryl-sulfinyl group (preferably a substituted or unsubstituted alkylsulfinyl group having 1 to 30 carbon atoms, or a substituted or unsubstituted arylsulfinyl group having 6 to 30 carbon atoms, e.g. a methylsulfinyl group, an ethylsulfinyl group, a phenylsulfinyl group, or a p-methylphenylsulfinyl group); an alkyl- or aryl-sulfonyl group (preferably a substituted or unsubstituted alkylsulfonyl group having 1 to 30 carbon atoms, or a substituted or unsubstituted arylsulfonyl group having 6 to 30 carbon atoms, e.g. a methylsulfonyl group, an ethylsulfonyl group, a phenylsulfonyl group, or a p-methylphenylsulfonyl group); an acyl group (preferably a formyl group, a substituted or unsubstituted alkylcarbonyl group having 2 to 30 carbon atoms, a substituted or unsubstituted arylcarbonyl group having 7 to 30 carbon atoms, or a substituted or unsubstituted heterocyclic carbonyl group having 4 to 30 carbon atoms, which is bonded to said carbonyl group through a carbon atom, e.g. an acetyl group, a pivaloyl group, a 2-chloroacetyl group, a stearoyl group, a benzoyl group, a p-n-octyloxyphenylcarbonyl group, a 2-pyridylcarbonyl group, or a 2-furylcarbonyl group); an aryloxycarbonyl group (preferably a substituted or unsubstituted aryloxycarbonyl group having 7 to 30 carbon atoms, e.g. a phenoxycarbonyl group, an o-chlorophenoxycarbonyl group, an m-nitrophenoxycarbonyl group, or a p-t-butylphenoxycarbonyl group); an alkoxycarbonyl group (preferably a substituted or unsubstituted alkoxycarbonyl group having 2 to 30 carbon atoms, e.g. a methoxycarbonyl group, an ethoxycarbonyl group, a t-butoxycarbonyl group, or an n-octadecyloxycarbonyl group); a carbamoyl group (preferably a substituted or unsubstituted carbamoyl group having 1 to 30 carbon atoms, e.g. a carbamoyl group, an N-methylcarbamoyl group, an N,N-dimethylcarbamoyl group, an N,N-di-n-octylcarbamoyl group, or an N-(methylsulfonyl)carbamoyl group); an aryl- or heterocyclic-azo group (preferably a substituted or unsubstituted aryl azo group having 6 to 30 carbon atoms, or a substituted or unsubstituted heterocyclic azo group having 3 to 30 carbon atoms, e.g. a phenylazo group, a p-chlorophenylazo group, or a 5-ethylthio-1,3,4-thiadiazol-2-ylazo group); an imido group (preferably an N-succinimido group or an N-phthalimido group); a phosphino group (preferably a substituted or unsubstituted phosphino group having 2 to 30 carbon atoms, e.g. a dimethylphosphino group, a diphenylphosphino group, or a methylphenoxyphosphino group); a phosphinyl group (preferably a substituted or unsubstituted phosphinyl group having 2 to 30 carbon atoms, e.g. a phosphinyl group, a dioctyloxyphosphinyl group, or a diethoxyphosphinyl group); a phosphinyloxy group (preferably a substituted or unsubstituted phosphinyloxy group having 2 to 30 carbon atoms, e.g. a diphenoxyphosphinyloxy group or a dioctyloxyphosphinyloxy group); a phosphinylamino group (preferably a substituted or unsubstituted phosphinylamino group having 2 to 30 carbon atoms, e.g. a dimethoxyphosphinylamino group or a dimethylaminophosphinylamino group); a silyl group (preferably a substituted or unsubstituted silyl group having 3 to 30 carbon atoms, e.g. a trimethylsilyl group, a t-butyldimethylsilyl group, or a phenyldimethylsilyl group).

Among the substituents, with respect to one having a hydrogen atom, the hydrogen atom may be removed and be substituted by any of the above-mentioned substituents. Examples thereof include: an alkylcarbonylaminosulfonyl group, an arylcarbonylaminosulfonyl group, an alkylsulfonylaminocarbonyl group, and an arylsulfonylaminocarbonyl group. Specific examples thereof include a methylsulfonylaminocarbonyl group, a p-methylphenylsulfonylaminocarbonyl group, an acetylaminosulfonyl group, and a benzoylaminosulfonyl group.

When the ultraviolet absorber represented by any one of the formulas (1) to (8) is water-soluble, it is preferred to have an ionic hydrophilic group. The ionic hydrophilic group includes a sulfo group, a carboxyl group, a phosphono group, and a quaternary ammonium group. As the ionic hydrophilic group, a carboxyl group, a phosphono group, and a sulfo group are preferred, and a carboxyl group and a sulfo group are particularly preferred. The carboxyl group, phosphono group, and sulfo group may be in the state of a salt, and the examples of the counter ions for forming the salts include an ammonium ion, an alkali metal ion (e.g., a lithium ion, a sodium ion, and a potassium ion), and an organic cation (a tetramethylammonium ion, a tetramethylguanidium ion, and a tetramethylphosphonium ion).

Among ultraviolet absorbers represented by any one of the Formulae (1) to (8), those represented by any one of the Formulae (1) to (4) are preferable in the point that they themselves have high light fastness, and those represented by any one of the Formulae (1) or (3) are further preferable in view of absorbing characteristics. Among these absorbers, those represented by the Formulae (1) or (3) are particularly preferable. In the case where the ultraviolet absorber is used in a basic condition, on the other hand, compounds represented by any one of the Formulae (4) to (8) are preferable from the viewpoint of preventing coloring caused by dissociation.

The compounds represented by any one of the formulae (1) to (8) can be synthesized by or according to any of the methods described, for example, in JP-B-48-30492, JP-B-55-36984, JP-B-55-125875, JP-B-36-10466, JP-B-48-5496, JP-A-46-3335, JP-A-58-214152, JP-A-58-221844, JP-A-47-10537, JP-A-59-19945, JP-A-63-53544, JP-A-51-56620, JP-A-53-128333, JP-A-58-181040, JP-A-6-211813, JP-A-7-258228, JP-A-8-239368, JP-A-8-53427, JP-A-10-115898, JP-A-10-147577, JP-A-10-182621, JP-T-8-501291 ("JP-T" means searched and published International patent publication), U.S. Pat. No. 3,754,919, No. 4,220,711, No. 2,719,086, No. 3,698,707, No. 3,707,375, No. 5,298,380, No. 5,500,332, No. 5,585,228, No. 5,814,438, British Patent No. 1,198,337, European Patents No. 323408A, No. 520938A, No. 521823A, No. 531258A, No. 530135A, and No. 520938A.

Also, the structures, material properties and action mechanisms of typical ultraviolet absorbers are described in Andreas Valet, "Light Stabilizers for Paint", issued by Vincentz.

Next, there is explained a heat transferable protective layer sheet used in the heat-sensitive transfer sheet for use in the present invention.

3) Heat-Sensitive Transfer Image-Receiving Sheet

Next, the heat-sensitive transfer image-receiving sheet (hereinafter also referred to as an image-receiving sheet) used in the present invention will be explained.

The heat-sensitive (thermal) transfer image-receiving sheet used in the present invention is provided with at least one dye-receiving layer (receptor layer) on a support. Moreover, it is preferable that the heat-sensitive (thermal) transfer image-receiving sheet used in the present invention is provided with at least one heat insulation layer (porous layer) between the support and the receptor layer. An intermediate layer such as a white-background-control layer, a charge-control layer (an electrification-control layer), an adhesive layer, and a primer layer, may be provided between the receptor layer and the support. When the heat insulation layer is provided, the receptor layer, the heat insulation layer and the intermediate layer are preferably formed by a simultaneous multi-layer coating. When the intermediate layer is provided, the receptor layer, the heat insulation layer, and the intermediate layer may be formed by the simultaneous multi-layer coating.

It is preferable that a curling control layer, a writing layer, or a charge-control layer be formed on the backside of the support. Each of these layers may be applied using a usual method such as a roll coating, a bar coating, a gravure coating, and a gravure reverse coating.

<Receptor Layer>

[Thermoplastic Resin]

In the present invention, a thermoplastic resin is preferably used in the receptor layer. Examples of the thermoplastic resin (polymer) that is preferably used in the receptor layer in the present invention include vinyl-series resins, such as halogenated polymers (e.g., polyvinyl chloride and polyvinylidene chloride), polyvinyl acetate, ethylene-vinyl acetate copolymer, vinyl chloride-vinyl acetate copolymer, poly acrylic acid ester, polystyrene, and polystyrene acrylate; acetal-series resins, such as polyvinylformal, polyvinylbutyral and polyvinylacetal; polyester-series resins, such as polyethylene terephthalate and polybutylene terephthalate; polycarbonate-series resins; cellulose-series resins, such as those described in JP-A-4-296595 and JP-A-2002-264543; cellulose-series resins, such as cellulose acetate butyrate (e.g., CAB551-0.2 and CAB321-0.1 (each trade name) manufactured by Eastman Chemical Company); polyolefin-series resins, such as polypropylene; and polyamide-series resins, such as urea resins, melamine resins and benzoguanamine resins. These resins may be used optionally blending with each other in the range of compatibility. Resins used for forming the receptor layer are also disclosed in JP-A-57-169370, JP-A-57-207250 and JP-A-60-25793.

It is further preferable that, among these polymers, the receptor layer preferably contain a polycarbonate, a polyester, a polyurethane, a polyvinyl chloride or its copolymer, a styrene-acrylonitrile copolymer, a polycaprolactone, or a mixture of two or more of these. It is particularly preferable that the receptor layer contain a polyester, a polyvinyl chloride or its copolymer, or a mixture of two or more of these.

The following is a more detailed explanation of polyester and polyvinyl chloride. Incidentally, these polymers may be used singly or as mixtures thereof.

(Polyester Polymers)

The polyester polymers used in the receptor layer in the present invention is explained in more detail.

The polyester polymers are obtained by polycondensation of a dicarboxylic acid component (including a derivative thereof) and a diol component (including a derivative thereof). The polyester polymers preferably contain an aromatic ring and/or an aliphatic ring. As to technologies related to the alicyclic polyester, those described in JP-A-5-238167 are useful from the viewpoints of ability to incorporate a dye and image stability.

In the present invention, as the polyester polymers, it is preferable to use polyester polymers obtained by polycondensation using at least one of the above-described dicarboxylic acid component and at least one of the above-described diol component, so that the thus-obtained polyester polymers could have a molecular weight (mass average molecular weight (Mw)) of generally about 11,000 or more, preferably about 15,000 or more, and more preferably about 17,000 or more. If polyester polymers of too low molecular weight are used, elastic coefficient of the formed receptor layer becomes low and also it raises lack of thermal resistance. Resultantly, it sometimes becomes difficult to assure the releasing property of the heat-sensitive transfer sheet and the image-receiving sheet. A higher molecular weight is more preferable from a viewpoint of increase in elastic coefficient. The molecular weight is not limited in particular, so long as such failure does not occur that a higher molecular weight makes the polymer difficult to be dissolved in a solvent for a coating solution at the time of forming the receptor layer, or that an adverse effect arises in adhesive properties of the receptor layer to a support (substrate sheet) after coating and drying the receptor layer. However, the molecular weight is preferably about 25,000 or less, and at highest a degree of about 30,000. The polyester polymers may be synthesized according to a known method.

Examples of a saturated polyester used as the polyester polymers, include VYLON 200, VYLON 290 and VYLON 600 (each trade name, manufactured by Toyobo Co., Ltd.), KA-1038C (trade name, manufactured by Arakawa Chemical Industries, Ltd.), and TP220 and TP235 (each trade name, manufactured by The Nippon Synthetic Chemical Industry Co., Ltd.).

(Vinyl Chloride Polymers)

The vinyl chloride polymers, particularly a copolymer using vinyl chloride, used in the receptor layer are explained in more detail.

The polyvinyl chloride copolymer is preferably one having a vinyl chloride constituent content of 85 to 97% by mass and a polymerization degree of 200 to 800. A monomer forming such a copolymer together with vinyl chloride has no particular restrictions, and any monomer may be used as far as it can be copolymerized with vinyl chloride. However, it is particularly preferably vinyl acetate. Accordingly, the polyvinyl chloride copolymer used in the receptor layer is advantageously a vinyl chloride-vinyl acetate copolymer. However, the vinyl chloride-vinyl acetate copolymer is not necessarily constituted of vinyl chloride and vinyl acetate alone, and may include vinyl alcohol and maleic acid constituents to an extent to which the effects of the present invention would be obtained. Examples of other monomer constituents of such a copolymer constituted mainly of vinyl chloride and vinyl acetate include vinyl alcohol and its derivatives such as vinyl propionate; acrylic or methacrylic acids and their derivatives such as their methyl, ethyl, propyl, butyl and 2-ethylhexyl esters; maleic acid and its derivatives such as diethyl maleate, dibutyl maleate and dioctyl maleate; vinyl ether derivatives such as methyl vinyl ether, butyl vinyl ether and 2-ethylhexyl vinyl ether; acrylonitrile and methacrylonitrile; and styrene. The ratio of each of the vinyl chloride and vinyl acetate components in the copolymer may be any ratio, but it is preferable that the ratio of the vinyl chloride component is 50 mass % or more of the copolymer. In addition, it is preferable that the ratio of the above-recited constituents other than the vinyl chloride and vinyl acetate is 10 mass % or less of the copolymer.

Examples of such a vinyl chloride-vinyl acetate copolymer include SOLBIN C, SOLBIN CL, SOLBIN CH, SOLBIN CN, SOLBIN C5, SOLBIN M, SOLBIN MF, SOLBIN A, SOLBIN AL (trade names, manufactured by Nissin Chemical Industry Co., Ltd.); S-LEC A, S-LEC C and S-LEC M (trade names, manufactured by Sekisui Chemical Co., Ltd.); and DENKA VINYL 1000GKT, DENKA VINYL 1000L, DENKA VINYL 1000CK, DENKA VINYL 1000A, DENKA VINYL 1000LK2, DENKA VINYL 1000AS, DENKA VINYL 1000GS, DENKA VINYL 1000LT3, DENKA VINYL 1000D and DENKA VINYL 1000W (trade names, manufactured by Denki Kagaku Kogyo Kabushiki Kaisha).

The above-recited polymers are dissolved in a proper solvent such as methyl ethyl ketone, ethyl acetate, benzene, toluene and xylene, so that the resultant solution can be coated on a support.

(Latex Polymer)

In the present invention, other than the aforementioned polymers, latex polymers can also be preferably used. Hereinafter, the latex polymer will be explained.

In the heat-sensitive transfer image-receiving sheet used in the present invention, the latex polymer used in the receptor layer is a dispersion in which hydrophobic polymers comprising a monomer unit of water-insoluble vinyl chloride are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm.

The particle size distribution of the dispersed particles is not particularly limited, and the particles may have either wide particle-size distribution or monodispersed particle-size distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer for use in the present invention is preferably −30° C. to 100° C., more preferably 0° C. to 80° C., further more preferably 10° C. to 70° C., and especially preferably 15° C. to 60° C.

As the latex polymer used in the receptor layer, use can be made of polyvinyl chlorides, a copolymer comprising vinyl chloride unit, such as a vinyl chloride-vinyl acetate copolymer and a vinyl chloride acrylate copolymer. In this case, the vinyl chloride unit in molar ratio is preferably in the range of from 50% to 95%. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to the layer containing the latex, and polymers having excessively large molecular weight bring about poor filming ability. Crosslinkable latex polymers are also preferably used.

The latex polymer that can be used in the present invention is commercially available, and polymers described below may be utilized. Examples thereof include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.).

These latex polymers may be used singly, or two or more of these polymers may be blended, if necessary.

In the receptor layer, a ratio of the latex polymer comprising a component of vinyl chloride is preferably 50 mass % or more of the whole solid content in the layer.

In the present invention, it is preferable to prepare the receptor layer by applying an aqueous type coating solution and then drying it. The "aqueous type" so-called here means that 60% by mass or more of the solvent (dispersion medium) of the coating solution is water. As a component other than water in the coating solution, a water miscible organic solvent may be used, such as methyl alcohol, ethyl alcohol, isopropyl alcohol, dimethylformamide, ethyl acetate, diacetone alcohol, furfuryl alcohol, benzyl alcohol, diethylene glycol monoethyl ether, and oxyethyl phenyl ether.

In combination with the above-described latex polymer for use in the present invention, any polymer can be used. The polymer that can be used in combination is preferably transparent or translucent, and colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, and polyamides. In the coating liquid, a binder may be dissolved or dispersed in an aqueous solvent or in an organic solvent, or may be in the form of an emulsion.

The glass transition temperature (Tg) of the binder for use in the present invention is preferably in the range of −30° C. to 90° C., more preferably −10° C. to 85° C., still more preferably 0° C. to 70° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Further, when phase separation occurs or when a core-shell structure is adopted, the weighted average Tg is preferably within the foregoing range.

[Releasing Agent]

In the present invention, it is preferable to use a releasing agent in the receptor layer in order to keep more securely the releasing property between the heat-sensitive transfer sheet and the image-receiving sheet at the time of printing images.

As the releasing agent, use can be made of ones described in the explanation of the heat sensitive layers.

In the present invention, the amount of the receptor layer to be applied is preferably 0.5 to 10 g/m$^2$ (solid basis, hereinafter, the amount to be applied in the present specification is a value on solid basis unless otherwise noted).

<Releasing Layer>

In the case where the hardened modified silicone oil is not added to the receptor layer, the silicone oil may be added to a releasing layer provided on the receptor layer. In this case, the receptor layer may be provided using at least one of the above-described thermoplastic resins. Besides, a receptor layer to which silicone is added may be used. The releasing layer contains a hardened modified silicone oil. A kind of the silicone to be used and a method of using the silicone are the same as for use in the receptor layer. Further, in the case where a catalyst or a retardant is used, the above described descriptions related to addition of these additives to the receptor layer may be applied. The releasing layer may be formed using only a silicone, or alternatively a mixture of a silicone and a binder resin having a good compatibility therewith. A thickness of the releasing layer is generally in the range of about 0.001 to about 1 μm.

Examples of the fluorine surfactants include Fluorad FC-430 and FC-431 (trade names manufactured by 3M).

(Heat Insulation Layer)

A heat insulation layer serves to protect the support from heat when a thermal head or the like is used to carry out a transfer operation under heating. Also, because the heat insulation layer generally has proper cushion characteristics, a heat-sensitive transfer image-receiving sheet having high printing sensitivity can be obtained even in the case of using paper as a support. The heat insulation layer may be a single layer, or multi-layers. The heat insulation layer is generally arranged at a nearer location to the support than the receptor layer.

In the image-receiving sheet of the present invention, the heat insulation layer contains hollow polymer particles.

The hollow polymer particles in the present invention are polymer particles having independent pores inside of the particles and hydrophilic polymer. Examples of the hollow polymer particles include (1) non-foaming type hollow particles obtained in the following manner: a dispersion medium, such as water, is contained inside of a capsule wall formed of a polystyrene, acrylic resin, or styrene/acrylic resin, and, after a coating solution is applied and dried, the dispersion medium in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

The particle size of the hollow polymer particles is preferably 0.1 to 20 μm, more preferably 0.1 to 2 μm, further preferably 0.1 to 1 μm, particularly preferably 0.2 to 0.8 μm. It is because an excessively small size may lead to decrease of the void ratio (hollow ratio) of the particles, prohibiting desirable heat-insulating property, while an excessively large size in relation to the film thickness of the heat insulation layer may result in problems in preparation of smooth surface and cause coating troubles due to the coarse or bulky particles.

The hollow ratio (percentage of hollowness) of the hollow polymer particles is preferably in the range of from about 20% to about 70%, and more preferably from 20% to 50%. If the hollow ratio is too small, it becomes difficult to obtain sufficient heat-insulating property. In contrast, if the hollow ratio is excessively higher, a proportion of incomplete hollow particles increases in the aforementioned preferable range of the particle size, so that it becomes difficult to obtain sufficient film strength.

The glass transition temperature (Tg) of the hollow polymer particles is preferably 70° C. or higher, more preferably 100° C. or higher. These hollow polymer particles may be used in combinations of two or more of those, according to the need.

Such hollow polymer particles are commercially available. Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names). Among these, the hollow polymer particles of the above (1) may be preferably used.

In the heat insulation layer containing the hollow polymer particles, a water-dispersible-type resin or water-soluble-type resin is preferably added, as a binder (binder resin). As the binder resin that can be used in the present invention, use may be made of a known resin, such as an acrylic resin, a styrene/acrylic copolymer, a polystyrene resin, a polyvinyl alcohol resin, a vinyl acetate resin, an ethylene/vinyl acetate copolymer, a vinyl chloride/vinyl acetate copolymer, a styrene/butadiene copolymer, a polyvinylidene chloride resin, a cellulose derivative, casein, starch, and gelatin. Also, these resins may be used either singly or as a mixture thereof.

The solid content of the hollow polymer particles in the heat insulation layer preferably falls in a range from 5 to 2,000 parts by mass, more preferably 5 to 1,000 parts by mass, and further preferably 5 to 400 parts by mass, assuming that the solid content of the binder resin be 100 parts by mass. Further, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, and thereby sufficient film strength cannot be obtained, causing deterioration in abrasion resistance.

A thickness of the heat insulation layer containing the hollow polymer particles is preferably from 5 to 50 μm, more preferably from 5 to 40 μm.

(Hydrophilic Polymer)

The heat insulation layer preferably contains a hydrophilic polymer (hereinafter also referred to as water-soluble polymer or a water-soluble high molecular compound). The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention.

The latex polymers recited above are not included in the water-soluble polymers which can be used in the present invention. In the present invention, the water-soluble polymer is also referred to as a binder, for differentiation from the latex polymer described above.

Herein, "water-soluble polymer" means a polymer which dissolves, in 100 g water at 20° C., in an amount of preferably 0.05 g or more, more preferably 0.1 g or more, further preferably 0.5 g or more, and particularly preferably 1 g or more.

Among the water-soluble polymers which can be used in the present invention, the natural polymers and the semi-synthetic polymers will be explained in detail. Specific examples include the following polymers: plant type polysaccharides such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Gelatin is one of preferable embodiments in the present invention. Gelatin having a molecular weight of from 10,000 to 1,000,000 may be used in the present invention.

Among water-soluble polymers that can be used in the present invention, especially synthetic polymers are explained in detail.

Examples of such the synthetic polymers include acrylic polymers such as polyacrylic acid; vinyl polymers such as polyvinyl alcohol; and others such as polyethylene glycol, polypropylene glycol, polyisopropylamide, polymethylvinyl ether, polyethyleneimine, polystyrene sulfonic acid or copolymers thereof, and water-soluble polyesters. Of these water-soluble polymers that can be used in the present invention, preferred are polyvinyl alcohols.

As the polyvinyl alcohols, there can be used various kinds of polyvinyl alcohols such as completely saponified products, partially saponified products, and a modified polyvinyl alcohols. With respect to these polyvinyl alcohols, those described in "Poval", authored by Koichi Nagano et al., published by Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", authored by Koichi Nagano et al., published by Kobunshi Kankokai, pp. 144-154. For example, a coated-surface quality can be improved by an addition of boric acid, and the addition of boric acid is preferable. The amount of boric acid added is preferably 0.01 to 40 mass % with respect to polyvinyl alcohol.

In the present invention, preferred water-soluble polymers are polyvinyl alcohols and gelatin, with gelatin being most preferred.

The amount of the water-soluble polymer added to the heat insulation layer is preferably from 1 to 75% by mass, more preferably from 1 to 50% by mass based on the entire mass of the heat insulation layer.

The heat insulation layer preferably contains a gelatin. The amount of the gelatin in the coating solution for the heat insulation layer is preferably 0.5 to 14% by mass, and particularly preferably 1 to 6% by mass. Further, the coating amount of the above hollow polymer particles in the heat insulation layer is preferably 1 to 100 g/m$^2$, and more preferably 5 to 20 g/m$^2$.

Further, the water-soluble polymers that are contained in the heat insulation layer may be cross-linked with a hardener in order to regulate cushion properties and film strength. Preferable examples of the hardener that can be used in the present invention include H-1, 4, 6, 8, and 14 in JP-A-1-214845 in page 17; compounds (H-1 to H-54) represented by one of the formulae (VII) to (XII) in U.S. Pat. No. 4,618,573, columns 13 to 23; compounds (H-1 to H-76) represented by the formula (6) in JP-A-2-214852, page 8, the lower right (particularly, H-14); and compounds described in claim 1 in U.S. Pat. No. 3,325,287. A preferred ratio of a cross-linked water-soluble polymer in the heat insulation layer varies depending on the kind of the crosslinking agent, but the water-soluble polymer in the heat insulation layer is crosslinked by preferably 0.1 to 20 mass %, more preferably 1 to 10 mass %, based on the entire water-soluble polymer.

In the present invention, it is also a preferable embodiment that a water-soluble polymer used in the heat insulation layer is also used in the above-described receptor layer. Preferable water-soluble polymers are the same as those of the heat insulation layer.

(Undercoat Layer)

An undercoat layer may be formed between the receptor layer and the heat insulation layer. As the undercoat layer, for example, at least one of a white background controlling layer, a charge controlling layer, an adhesive layer, and a primer layer is formed. These layers may be formed in the same manner as those described in, for example, each specification of Japanese Patent Nos. 3585599 and 2925244.

(Support)

There is no particular limitation to the support that can be used in the present invention. However, preferred are supports known in the field of heat-sensitive transfer image-receiving sheets. A water-proof support is particularly preferably used. The use of the waterproof support makes it possible to prevent the support from absorbing moisture, whereby a fluctuation in the performance of the receptor layer with lapse of time can be prevented. As the waterproof support, for example, coated paper or laminate paper may be used.

The method of producing the heat-sensitive transfer image-receiving sheet for use in the present invention is explained below.

The heat-sensitive transfer image-receiving sheet for use in the present invention can be preferably formed, by applying at least one receptor layer, at least one intermediate layer and at least one heat-insulation layer, on a support, through simultaneous multi-layer coating.

In the case where a single layer is coated on a support, there can be preferably used a coating method such as coat with a bar coater and slide coat. Further, in the case of production for the heat-sensitive transfer image-receiving sheet composed of multiple layers having different functions from each other, such as an air void layer, a heat insulation layer, an interlayer, and a receptor layer, there can be used a known coating method such as a slide coating method and a curtain coating method.

In the present invention, the productivity is greatly improved and, at the same time, image defects can be remarkably reduced, by using the above simultaneous multilayer coating for the production of an image-receiving sheet having a multilayer structure.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

In the image-forming method (system) of the present invention, imaging is achieved by superposing a heat-sensitive transfer sheet on a heat-sensitive transfer image-receiving sheet so that a heat transfer layer of the heat-sensitive transfer sheet is in contact with a receptor layer of the heat-sensitive transfer image-receiving sheet and giving thermal energy in accordance with image signals given from a thermal head.

Specifically, image-forming can be achieved by the similar manner to that as described in, for example, JP-A-2005-88545. In the present invention, a printing time is preferably less than 15 seconds, and more preferably in the range of 5 to 12 seconds, from the viewpoint of shortening a time taken until a consumer gets a print.

(Measurement Method of Coefficient of Static Friction)

The coefficient of static friction that is used in the present invention is measured according to JIS K7125. However, as a measuring instrument, TRIBOGEAR Type 14 manufactured by SHINTO SCIENCE is used. The coefficient of static friction is measured at the state in which a sample holder is heated at 100° C.

The present invention can provide a heat-sensitive transfer sheet and an image forming method using a heat-sensitive transfer system in which sticking is difficult to occur and also unevenness of the print density is a little.

The present invention will be described in more detail based on the following examples, but the invention is not intended to be limited thereto. In the following examples, the terms "part(s)" and "%" are values by mass, unless otherwise specified.

EXAMPLES

[Preparation of Heat Transfer Sheets]

(Preparation of Heat-Sensitive Transfer Sheet-Coating Liquid and Protective Layer-Coating Liquid)

For preparation of heat-sensitive transfer sheets, the following coating liquids were prepared.

| Preparation of yellow-heat-transfer-layer-coating liquid PY-1 | |
|---|---|
| Yellow dye compound (Y1-6) | 3.9 parts by mass |
| Yellow dye compound (Y3-7) | 3.9 parts by mass |
| Polyvinylacetoacetal resin (trade name: ESLEC KS-1, manufactured by Sekisui Chemical Co., Ltd.) | 6.1 parts by mass |
| Polyvinylbutyral resin (trade name: DENKA BUTYRAL #6000-C, manufactured by DENKI KAGAKU KOGYOU K. K.) | 2.1 parts by mass |
| Releasing agent (trade name KF-96-3000cs, manufactured by Shin-Etsu Chemical Co., Ltd.) | 0.06 part by mass |
| Matting agent (trade name: Flo-thene UF, manufactured by Sumitomo Seika Chemicals Co., Ltd.) | 0.15 part by mass |
| Methyl ethyl ketone/toluene (2/1, at mass ratio) | 84 parts by mass |
| Preparation of magenta-heat-transfer-layer-coating liquid PM-1 | |
| Magenta dye compound (M1-2) | 0.1 parts by mass |
| Magenta dye compound (M2-1) | 0.7 parts by mass |
| Magenta dye compound (M2-3) | 6.6 parts by mass |
| Cyan dye compound (C2-2) | 0.4 parts by mass |
| Polyvinylacetal resin (trade name: ESLEC KS-1, manufactured by Sekisui Chemical Co., Ltd.) | 8.0 parts by mass |
| Polyvinylbutyral resin (trade name: DENKA BUTYRAL #6000-C, manufactured by DENKI KAGAKU KOGYOU K. K.) | 0.2 parts by mass |
| Releasing agent (trade name: KF-96-3000cs, manufactured by Shin-Etsu Chemical Co., Ltd.) MOMENTIVE Performance Materials Japan LLC.) | 0.06 part by mass |
| Matting agent (trade name: Flo-thene UF, manufactured by Sumitomo Seika Chemicals Co., Ltd.) | 0.15 part by mass |
| Methyl ethyl ketone/toluene (2/1, at mass ratio) | 84 parts by mass |
| Preparation of cyan-heat-transfer-layer-coating liquid PC-1 | |
| Cyan dye compound (C1-3) | 1.2 parts by mass |
| Cyan dye compound (C2-2) | 6.6 parts by mass |
| Polyvinylacetal resin (trade name: ESLEC KS-1, manufactured by Sekisui Chemical Co., Ltd.) | 7.4 parts by mass |
| Polyvinylbutyral resin (trade name: DENKA BUTYRAL #6000-C, manufactured by DENKI KAGAKU KOGYOU K. K.) | 0.8 parts by mass |
| Releasing agent (trade name: KF-96-3000cs, manufactured by Shin-Etsu Chemical Co., Ltd.) MOMENTIVE Performance Materials Japan LLC.) | 0.06 part by mass |
| Matting agent (trade name: Flo-thene UF, manufactured by Sumitomo Seika Chemicals Co., Ltd.) | 0.15 part by mass |
| Methyl ethyl ketone/toluene (2/1, at mass ratio) | 84 parts by mass |
| Preparation of heat-transferable releasing-layer-coating liquid PU1 for protective layer | |
| Modified cellulose resin (trade name: L-30, manufactured by DAICEL CHEMICAL INDUSTRIES, LTD.) | 5.0 parts by mass |
| Methyl ethyl ketone | 95.0 parts by mass |
| Preparation of heat-transferable releasing-layer-coating liquid PO1 for protective layer | |
| Acrylic resin solution (Solid content: 40%) (trade name: UNO-1, manufactured by Gifu Ceramics Limited) | 90 parts by mass |
| Methanol/isopropanol (1/1, at mass ratio) | 10 parts by mass |
| Preparation of heat-transferable adhesive-layer-coating liquid A1 for protective layer | |
| Acrylic resin (trade name: DIANAL BR-77, manufactured by MITSUBISHI RAYON CO., LTD.) | 25 parts by mass |
| The following ultraviolet absorber UV-1 | 1 part by mass |
| The following ultraviolet absorber UV-2 | 2 parts by mass |
| The following ultraviolet absorber UV-3 | 1 part by mass |
| The following ultraviolet absorber UV-4 | 1 part by mass |

-continued

| | |
|---|---|
| PMMA fine particles (polymethyl methacrylate fine particles) | 0.4 part by mass |
| Methyl ethyl ketone/toluene (2/1, at mass ratio) | 70 parts by mass |

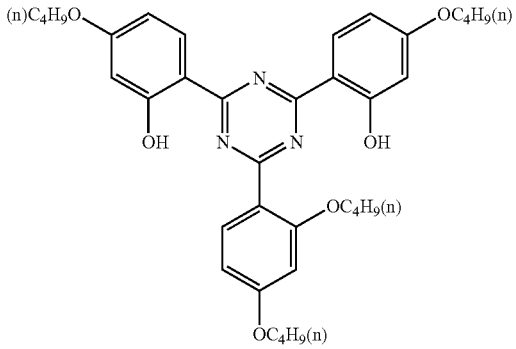

(UV-1)

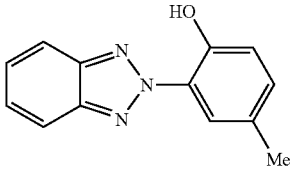

(UV-2)

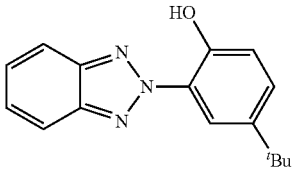

(UV-3)

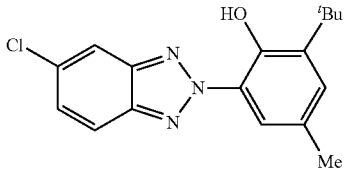

(UV-4)

(Preparation of Back-Layer-Coating Liquid)

In order to produce a back heat resistance layer of the heat-sensitive transfer sheet, the following coating liquid was prepared.

| Preparation of back side layer-coating solution BC1 | |
|---|---|
| Acrylic-series polyol resin (trade name: ACRYDIC A-801, manufactured by Dainippon Ink and Chemicals, Incorporated) | 26.0 parts by mass |
| Zinc stearate (trade name: SZ-2000, manufactured by Sakai Chemical Industry Co., Ltd.) | 0.43 part by mass |
| Phosphate (trade name: PLYSURF A217, manufactured by Dai-ichi Kogyo Seiyaku Co., Ltd.) | 1.27 parts by mass |
| Isocyanate (50% solution) (trade name: BURNOCK D-800, manufactured by Dainippon Ink and Chemicals, Incorporated) | 8.0 parts by mass |
| Methyl ethyl ketone/toluene (2/1, at mass ratio) | 64 parts by mass |

(Preparation of Sheets by Coating of Coating Liquids Described Above)

A polyester film 6.0 μm in thickness (trade name: Diafoil K200E-6F, manufactured by MITSUBISHI POLYESTER FILM CORPORATION), that was subjected to an adhesion-treatment on one surface of the film, was used as a support. The following back side-layer coating solution was applied onto the support on the other surface that was not subjected to the adhesion-treatment, so that the coating amount based on the solid content after drying would be 1 g/m$^2$. After drying, the coated film was hardened by heat at 60° C.

A heat-sensitive transfer sheet A was prepared by coating the above-described coating liquids on the easy adhesion layer coating side of the thus-prepared polyethylene film so that a yellow heat transfer layer, a magenta heat transfer layer, a cyan heat transfer layer, and a protective layer could be disposed sequentially in this order. In the case of forming a protective layer, after applying and drying of PU-1, namely a heat-transferable releasing-layer-coating liquid for protective layer on a substrate, PO-1, a heat-transferable releasing-layer-coating liquid for protective layer was applied thereon and dried. After that, A1, namely, a heat-transferable adhesive-layer-coating liquid for protective layer was applied and then dried.

A coating amount of each of five layers applied in this preparation was controlled so that the solid content coating amount would become the value set forth below.

| | |
|---|---|
| Yellow heat-transfer layer | 0.8 g/m$^2$ |
| Magenta heat-transfer layer | 0.8 g/m$^2$ |
| Cyan heat-transfer layer | 0.8 g/m$^2$ |
| Protective releasing layer | 0.3 g/m$^2$ |
| Protective-layer layer | 0.5 g/m$^2$ |
| Protective adhesive layer | 2.2 g/m$^2$ |

Samples 100 to 108 were prepared in the same manner as the heat-sensitive transfer sheet A, except for changing kinds and addition amounts of the releasing agent of each heat-sensitive transfer sheet as described in Table 1 set forth below.

[Preparation of Heat Sensitive Image-Receiving Sheet]

Preparation of Image-Receiving Sheet S1

A paper support, on both sides of which polyethylene was laminated, was subjected to corona discharge treatment on the surface thereof, and then a gelatin undercoat layer containing sodium dodecylbenzenesulfonate was disposed on the treated surface.

A heat insulation layer and a receptor layer each having the following composition were multilayer-coated on the gelatin undercoat layer, in the state that a subbing layer, the heat insulation layer, a lower layer of the receptor layer, a upper layer of the receptor layer were laminated in this order from the side of the support, by a method illustrated in FIG. 9 in U.S. Pat. No. 2,761,791. The coating was performed so that coating amounts of the subbing layer, the heat insulation layer, the lower layer of the receptor layer, the upper layer of the receptor layer after drying would be 6.7 g/m$^2$, 8.6 g/m$^2$, 2.6 g/m$^2$ and 2.7 g/m$^2$, respectively.

| | |
|---|---|
| Upper layer of the receptor layer | |
| Vinyl chloride-series latex (trade name: Vinybran 900, manufactured by Nisshin Chemicals Co., Ltd.) | 22.2 parts by mass |
| Vinyl chloride-series latex (trade name: Vinybran 276, manufactured by Nisshin Chemicals Co., Ltd.) | 2.5 parts by mass |
| Gelatin | 0.5 parts by mass |
| Ester-series wax EW-1 presented below | 2.0 parts by mass |
| Surfactant F-1 presented below | 0.04 parts by mass |
| Lower layer of the receptor layer | |
| Vinyl chloride-series latex (trade name: Vinybran 690, manufactured by Nisshin Chemicals Co., Ltd.) | 24.4 parts by mass |
| Gelatin | 1.4 parts by mass |
| Surfactant F-1 presented below | 0.04 parts by mass |
| Heat insulation layer | |
| Hollow latex polymer (trade name: MH5055, manufactured by Nippon Zeon Co., Ltd.) | 579 parts by mass |
| Gelatin | 279 parts by mass |
| Subbing layer | |
| Polyvinyl alcohol (PovalPVA205, trade name, manufactured by KURARY CO., LTD.) | 16.8 parts by mass |
| Styren-Butadiene rubber latex (as sold content) (SN-307, trade name, manufactured by NIPPON A&L INC.) | 150 parts by mass |
| Surfactant F-1 presented below | 0.1 parts by mass |

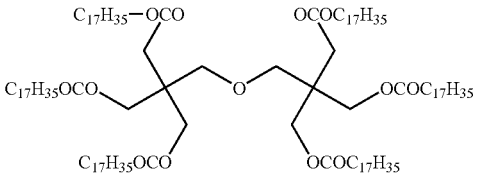

(EW-1)

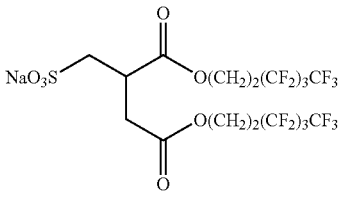

(F-1)

[Image Forming]

Each of the above-described ink sheets and the heat-sensitive transfer image-receiving sheet SI were processed so that they became loadable in a sublimation type printer ASK 2000 (trade name) manufactured by Fuji Film Corporation. Then, image was output in a high speed print mode to prepare sample 100. In this case, a line speed was 0.73 m sec/line and the highest ultimate temperature was 450° C.

[Evaluation Test]

Samples 101 to 105 were prepared in the same manner as the heat-sensitive transfer sheet 100, except for changing addition amounts of the releasing agent as described in Table 1 set forth below.

50 sheets of print were output using digital image information from which KG sized solid black image ((R, G, B)=(0, 0, 0)) would be formed. Further, in order to measure unevenness of the print density of the $50^{th}$ sheet, V densities at 30 points were measured using X-rite 530 LP (a product of X-rite Corporation). Herein, V density (Visual density) means a value obtained by measurement with Macbeth RD-918 type reflection densitometer (visual filter).

A difference between the maximum density and the minimum density was indicated as Δ density. The larger the unevenness of the print density, the larger the Δ density becomes. The thus-obtained results are shown in Table 1.

(Preparation of Heat-Transfer Image-Receiving Sheets)

Preparation of an Image-Receiving Sheet S2

A synthetic paper (trade name: Yupo FPG 200, manufactured by Yupo Corporation, thickness: 200 μm) was used as the support; and, on one surface of the support, a white intermediate layer and a receptor layer, having the following compositions, were coated in this order by a bar coater. The coating was carried out such that the amount of the white intermediate layer and the amount of the receptor layer after each layer was dried would be 1.0 g/m$^2$ and 4.0 g/m$^2$, respectively, and these layers were respectively dried at 110° C. for 30 seconds.

| White intermediate layer | |
|---|---|
| Polyester resin (Trade name: Vylon 200, manufactured by Toyobo Co., Ltd.) | 10 parts by mass |
| Fluorescent whitening agent (Trade name: Uvitex OB, manufactured by Ciba-Geigy) | 1 part by mass |
| Titanium oxide | 30 parts by mass |
| Methyl ethyl ketone/toluene (1/1, at mass ratio) | 90 parts by mass |

TABLE 1

| Sample No. | Releasing agent | Addition amount of releasing agent (Parts) Yellow | Magenta | Cyan | Coating amount of releasing agent (mg/m$^2$) Yellow | Magenta | Cyan | Coefficient of static friction: Yellow heat transfer layer and image-receiving sheet | Magenta heat transfer layer and yellow solid print image-receiving sheet | Cyan heat transfer layer and yellow/magenta solid print image-receiving sheet | Δ density | Remarks |
|---|---|---|---|---|---|---|---|---|---|---|---|---|
| 100 | KF-96-3000cs | 0.06 | 0.06 | 0.06 | 3.0 | 3.0 | 3.0 | 0.62 | 0.62 | 0.62 | 0.12 | Comparative example |
| 101 | KF-96-3000cs | 0.12 | 0.06 | 0.06 | 5.9 | 3.0 | 3.0 | 0.35 | 0.62 | 0.62 | 0.09 | Comparative example |
| 102 | KF-96-3000cs | 0.06 | 0.12 | 0.06 | 3.0 | 5.9 | 3.0 | 0.62 | 0.33 | 0.62 | 0.08 | Comparative example |
| 103 | KF-96-3000cs | 0.06 | 0.06 | 0.12 | 3.0 | 3.0 | 5.9 | 0.62 | 0.62 | 0.33 | 0.08 | Comparative example |
| 104 | KF-96-3000cs | 0.06 | 0.1 | 0.12 | 3.0 | 4.9 | 5.9 | 0.62 | 0.43 | 0.33 | 0.02 | This invention |
| 105 | KF-96-3000cs | 0.04 | 0.08 | 0.1 | 2.0 | 3.9 | 4.9 | 0.67 | 0.54 | 0.38 | 0.03 | This invention |
| 106 | Megafac F470 | 0.06 | 0.1 | 0.12 | 3.0 | 4.9 | 5.9 | 0.64 | 0.48 | 0.35 | 0.02 | This invention |
| 107 | KF-96-3000cs | 0.002 | 0.03 | 0.08 | 0.10 | 1.5 | 3.9 | 0.95 | 0.72 | 0.52 | 0.04 | This invention |
| 108 | KF-96-3000cs | 0.1 | 0.12 | 0.24 | 4.9 | 5.9 | 11.7 | 0.43 | 0.33 | 0.12 | 0.04 | This invention |

From the results shown in the above table 1, it is understood that, as compared to Comparative examples, the Δ density is lower (namely unevenness of the print density is less generated) with respect to the heat-sensitive transfer materials having the characteristic composition of the present invention.

Example 2

The similar test as in the example 1 was performed and the similar results were obtained, in this case the following heat transfer image-receiving sheet was used in place of the image-receiving sheet S1 used in the example 1.

-continued

| Receptor layer | |
|---|---|
| Vinyl chloride/vinyl acetate resin (Trade name: Solbin A, manufactured by Nisshin Chemicals Co., Ltd.) | 100 parts by mass |
| Amino-modified silicone (Trade name: X22-3050C, manufactured by Shin-Etsu Chemical Co., Ltd.) | 5 parts by mass |
| Epoxy-modified silicone (Trade name: X22-300E, manufactured by Shin-Etsu Chemical Co., Ltd.) | 5 parts by mass |
| Methyl ethyl ketone/toluene (1/1, at mass ratio) | 400 parts by mass |

Having described our invention as related to the present embodiments, it is our intention that the invention not be limited by any of the details of the description, unless otherwise specified, but rather be construed broadly within its spirit and scope as set out in the accompanying claims.

I claim:

1. A heat-sensitive transfer sheet that is used in an image-forming method using a heat-sensitive transfer system, which method comprises the steps of superposing the heat-sensitive transfer sheet having at least one yellow heat transfer layer, at least one magenta heat transfer layer, and at least one cyan heat transfer layer on a support, and a heat-sensitive transfer image-receiving sheet having at least one dye receptor layer on a support, and then transferring at least three kinds of heat transferable dyes to the dye receptor layer sequentially, which heat-sensitive transfer sheet satisfies the following Formula (1):

$$\mu 1>\mu 2>\mu 3m \qquad \text{Formula (1)}$$

where μ1 is the coefficient of static friction between a first color heat transfer layer and the image-receiving sheet having a value in a range from 0.4 to 1.0, and μ2 is the coefficient of static friction between a second color heat transfer layer and a first color solid print image-receiving sheet having a value in a range from 0.2 to 0.8, and μ3 is the coefficient of static friction between a third color heat transfer layer and a first color/second color solid print image-receiving sheet having a value in a range from 0.1 to 0.6, wherein said heat-sensitive transfer image-receiving sheet contains hollow polymer particles and a hydrophilic polymer between the dye receptor layer and the support.

2. The heat-sensitive transfer sheet according to claim 1, wherein said first color heat transfer layer is the yellow heat transfer layer, said second color heat transfer layer is the magenta heat transfer layer, and said third color heat transfer layer is the cyan heat transfer.

3. An image-forming method using a heat-sensitive transfer system comprising the steps of: superposing a heat-sensitive transfer sheet having at least one yellow heat transfer layer, at least one magenta heat transfer layer, and at least one cyan heat transfer layer on a support and a heat-sensitive transfer image-receiving sheet having at least one dye receptor layer on a support, and then transferring at least three kinds of heat transferable dyes to the dye receptor layer sequentially, said image-forming method satisfying the following Formula (1):

$$\mu 1>\mu 2>\mu 3m \qquad \text{Formula (1)}$$

where is the coefficient of static friction between a first color heat transfer layer and the image-receiving sheet having a value in a range from 0.4 to 1.0, and μ2 is the coefficient of static friction between a second color heat transfer layer and a first color solid print image-receiving sheet having a value in a range from 0.2 to 0.8, and μ3 is the coefficient of static friction between a third color heat transfer layer and a first color/second color solid print image-receiving sheet having a value in a range from 0.1 to 0.6, wherein said heat-sensitive transfer image-receiving sheet contains hollow polymer particles and a hydrophilic polymer between the dye receptor layer and the support.

4. The image-forming method according to claim 3, wherein said first color heat transfer layer is the yellow heat transfer layer, said second color heat transfer layer is the magenta heat transfer layer, and said third color heat transfer layer is the cyan heat transfer.

* * * * *